US012305491B2

(12) United States Patent
McGarian

(10) Patent No.: US 12,305,491 B2
(45) Date of Patent: May 20, 2025

(54) DOWNHOLE TOOL

(71) Applicant: Bruce McGarian, Aberdeen (GB)

(72) Inventor: Bruce McGarian, Aberdeen (GB)

(73) Assignee: ODFJELL TECHNOLOGY INVEST LTD, Aberdeen (GB)

( * ) Notice: Subject to any disclaimer, the term of this patent is extended or adjusted under 35 U.S.C. 154(b) by 0 days.

(21) Appl. No.: 18/038,175

(22) PCT Filed: Nov. 12, 2021

(86) PCT No.: PCT/GB2021/052931

§ 371 (c)(1),
(2) Date: May 22, 2023

(87) PCT Pub. No.: WO2022/106811

PCT Pub. Date: May 27, 2022

(65) Prior Publication Data

US 2024/0011372 A1 Jan. 11, 2024

(30) Foreign Application Priority Data

| | | |
|---|---|---|
| Nov. 22, 2020 | (GB) | 2018337 |
| Nov. 25, 2020 | (GB) | 2018527 |
| Jun. 21, 2021 | (GB) | 2108895 |

(51) Int. Cl.
*E21B 43/112* (2006.01)
*E21B 23/04* (2006.01)
(Continued)

(52) U.S. Cl.
CPC ..... *E21B 43/112* (2013.01); *E21B 23/0412* (2020.05); *E21B 29/005* (2013.01); *E21B 33/1285* (2013.01)

(58) Field of Classification Search
CPC .. E21B 43/112; E21B 23/0412; E21B 29/005; E21B 33/1285; E21B 43/11
See application file for complete search history.

(56) References Cited

U.S. PATENT DOCUMENTS 5,343,949 A 9/1994 Ross et al.
7,694,746 B2 4/2010 Richard et al.
(Continued)

FOREIGN PATENT DOCUMENTS

EP 2616625 B1 * 11/2016 ..... E21B 10/322

OTHER PUBLICATIONS

International Search Report and Written Opinion for PCT/GB2021/052931, mailed Jan. 24, 2022.

*Primary Examiner* — Daniel P Stephenson
(74) *Attorney, Agent, or Firm* — Klarquist Sparkman, LLP

(57) ABSTRACT

A downhole tool, comprising: an inner body, having first and second connections in a drill string to convey fluid from immediately upper to immediately lower components. The inner body defines a flow bore which communicates between the first and second connections. An outer body disposed around at least part of the inner body is axially movable with respect to the inner body, in a direction which is parallel or substantially parallel with a longitudinal axis of the tool, such that introduction of pressurised fluid into pressure chambers tends to drive the outer body axially with respect to the inner body. The tool further comprises a component which is activated or operated by axial movement of the outer body with respect to the inner body.

20 Claims, 11 Drawing Sheets

(51) Int. Cl.
*E21B 29/00* (2006.01)
*E21B 33/128* (2006.01)

(56) References Cited

U.S. PATENT DOCUMENTS

| | | | | |
|---|---|---|---|---|
| 8,336,615 | B2 * | 12/2012 | Hughes | E21B 23/06 166/120 |
| 10,975,656 | B2 * | 4/2021 | Hrupp | E21B 23/06 |
| 2008/0011471 | A1 | 1/2008 | Hughes et al. | |
| 2009/0056956 | A1 | 3/2009 | Ingram | |
| 2015/0267513 | A1 * | 9/2015 | Lee | E21B 33/1285 166/298 |
| 2024/0011372 | A1 * | 1/2024 | McGarian | E21B 23/0412 |

* cited by examiner

A
B
C
D
E
F
G
H

DOWNHOLE TOOL

CROSS REFERENCE TO RELATED APPLICATIONS

This is the U.S. National Stage of International Application No. PCT/GB2021/052931, filed Nov. 12, 2021, which was published in English under PCT Article 21 (2), which in turn claims the benefit of Great Britain Application No. 2018337.2, filed Nov. 22, 2020, Great Britain Application No. 2018527.8, filed Nov. 25, 2020, and Great Britain Application No. 2108895.0, filed Jun. 21, 2021. The prior applications are incorporated herein in their entirety.

This application relates to a downhole tool, and in particular concerns a tool including one or more blades or other members which may be driven outwardly with respect to a tool body, for instance to perforate or split the casing of a wellbore.

Perforating tools are well-known in the fields of downhole exploration and extraction of fossil fuels. The most common reason to create perforations in a wellbore casing is to allow communication between the wellbore and a surrounding productive reservoir.

In known perforating tools, a series of axially spaced pistons are provided, such that when the pistons are activated, the forces generated by the pistons act cumulatively, to drive blades outwardly into contact with the interior surface of the casing with sufficient force to perforate or otherwise break the casing. Perforation guns, which use explosive charges to punch holes through a casing, are also used in some applications.

An example of this can be seen in EP2616625. This document discloses a tool in which a series of axially-spaced pistons are disposed within the tool body, and can be hydraulically activated to drive cutter blocks outwardly and into engagement with the casing of a wellbore.

It is an object of the invention to provide an improved tool of this type.

Accordingly, one aspect of the present invention provides a tool and method according to the independent claims. Preferred features of the tool and method are set out in the dependent claims.

In order that the invention may be more readily understood, embodiments thereof will now be described, by way of example, with reference to the accompanying drawings, in which:

FIG. 1 shows a tool 1 embodying the present invention.

Figures 1, 2, 3:
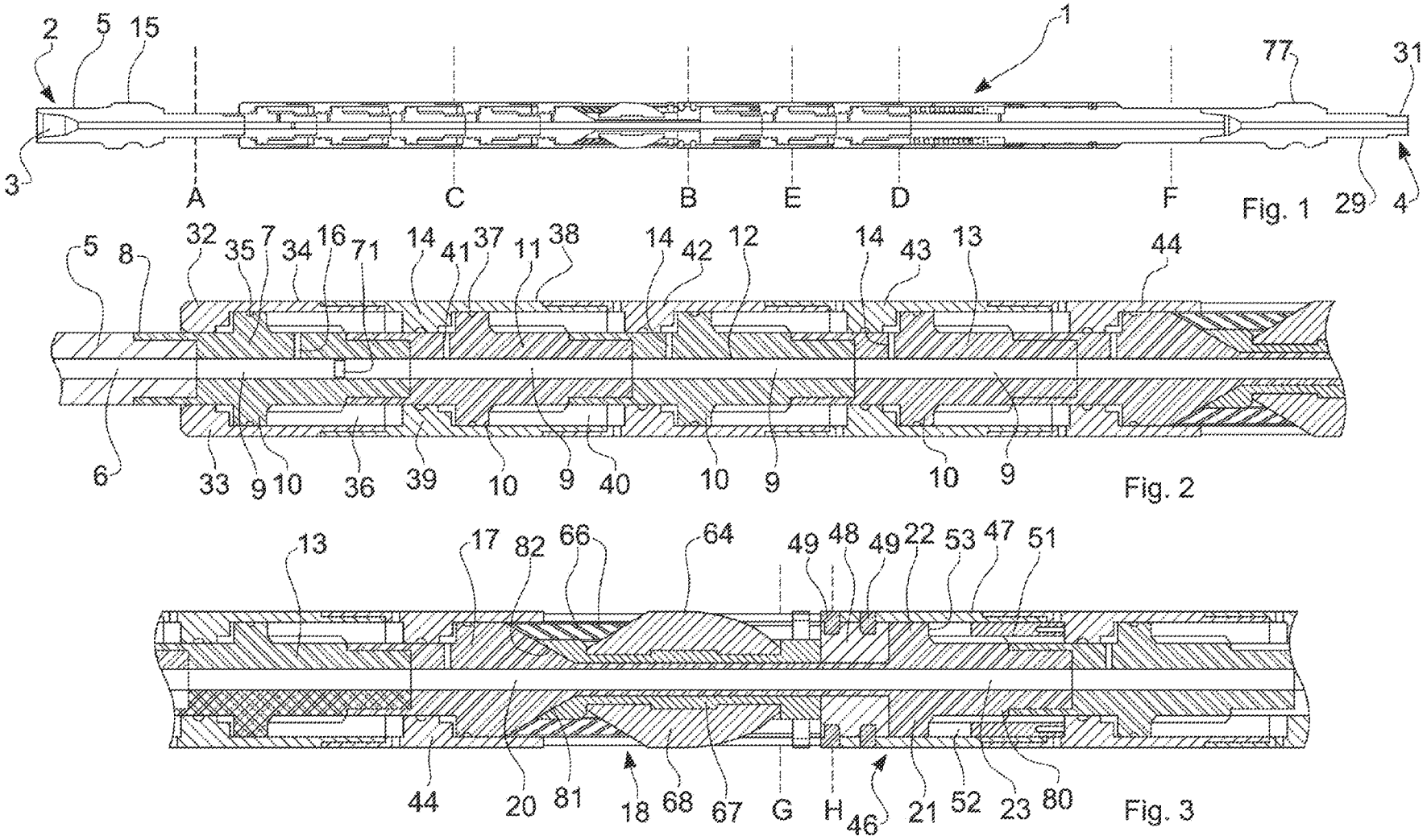
FIG. 1 shows a tool embodying the present invention in a first configuration.
FIGS. 2, 3 and 6 are more detailed images of parts of the tool of FIG. 1.

The tool 1 is elongate and is intended to be incorporated into a drill string along with other components, as is known in the art.

In the figures for this application, tools and parts of tools are generally shown with a top end thereof positioned on the left-hand side of the page, and the bottom end at the right-hand side of the page. As the skilled reader will understand, the drill string extends from the surface, and the end of the tool which is closer to the connection to the surface is referred to as the "top" end of the tool. This is by way of convenience and convention, and does not exclude orientations in which this end of the tool is not uppermost.

At the top end 2 of the tool 1, a threaded connection 3 is provided, to connect the tool 1 to the next uppermost tool or component in the drill string. Similarly, at its bottom end 4, the tool 1 has a lower threaded connection 31, for connection to the next lowermost tool or component in the drill string.

FIG. 2 shows a zoomed-in view of the tool 1, between the lines indicated by A and B in FIG. 1. FIG. 2 therefore shows an upper part of the tool 1.

The upper threaded connection 3 is provided in an upper connection piece 5, which has a central bore 6 running therethrough. As can be seen in FIG. 1, the upper connection piece has a centraliser 15 partway along its length. The centraliser 15 comprises a widened section, which is intended to fill or substantially fill the internal diameter of the casing, and assist in keeping the other components of the tool 1 centralised within the wellbore.

At its lower end, the upper connection piece 5 is connected to a first piston inner 7. This connection is preferably made by a threaded connection. In the example shown two O-rings 8 are provided as part of this connection, to form an effective seal between these components 5, 7.

The first piston inner 7 is generally cylindrical, having a central flow bore 9 passing therethrough. Near its top end, the first piston inner 7 has a protruding radial flange 10.

At its bottom end, the first piston inner 7 is connected to a second piston inner 11, which is preferably similar in shape to the first piston inner 7, being generally cylindrical with a protruding radial flange 10.

Attached to the lower end of the second piston inner is a third piston inner 12, and connected to the lower end of the third piston inner 12 is a fourth piston inner 13.

While the first to fourth piston inners 7-13 are preferably identical or substantially identical, this need not be the case. However, in the example shown, each of the piston inners is generally cylindrical, having a protruding radial flange 10 near its top end. The first to fourth piston inners 7-13 are preferably each connected to one another by way of threaded connections, although any other suitable connection method may be used.

Each of the second to fourth piston inners 11-13 has a communication port 14 which extends radially through the body of the piston inner 11-13, and provides communication between the central bore 9 and the exterior of the piston inner, at a position above (i.e. closer to the top end 2 than) the radial flange 10.

In contrast to the second to fourth piston inners 11-13, the first piston inner 7 has a communication port 16 which is positioned below the radial flange 10.

FIG. 3 shows a zoomed-in view of the tool 1, showing the region between the lines indicated by C and D in FIG. 1. The fourth piston inner 13 can be seen at the left-hand side of FIG. 3.

Figure 4:
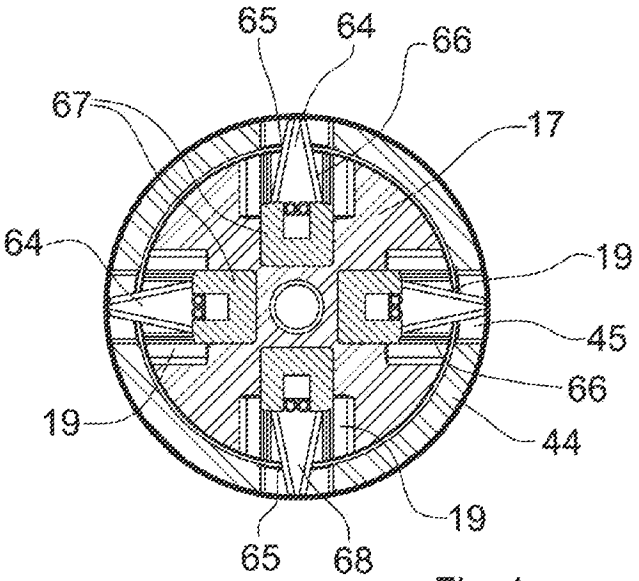

At its lower end, the fourth piston inner 13 connects to a blade carrier 17. At its upper end, the blade carrier 17 is generally solid and cylindrical. In a mid-section 18 thereof, the blade carrier 17 defines four pockets 19, each comprising a cut-out section in the cross-sectional shape of the blade carrier 17, which extends part of the way from the circumference of the blade carrier 17 towards the centre thereof. FIG. 4 shows a cross-sectional view of the tool, at the position indicated by G in FIG. 4. As can be seen in FIG. 4, the blade carrier 17 defines four radially spaced-apart pockets 19. In the embodiment shown, the pockets 19 are equally radially spaced apart from each other, i.e. are each set at exactly or substantially 90° with respect to the adjacent pockets 19. Embodiments of the invention may have any number of pockets, however, and it is not necessary for the pockets to be evenly radially spaced, or for a pocket to be directly radially opposite to another pocket.

The pockets 19 are elongate, and extend over a significant portion of the length of the blade carrier 17.

The blade carrier 17 has a central flow bore 20 running along the length thereof.

At its lower end, below the pockets 19, the blade carrier 17 comprises a stop component 21. The stop component 21 is generally cylindrical, having an outwardly-protruding flange 22 and a further section 80 which extends downwardly below the flange 22.

In the example shown the stop component 21 is formed integrally with the blade carrier 17, as a single member, but in other embodiments this need not be the case.

Figure 6:
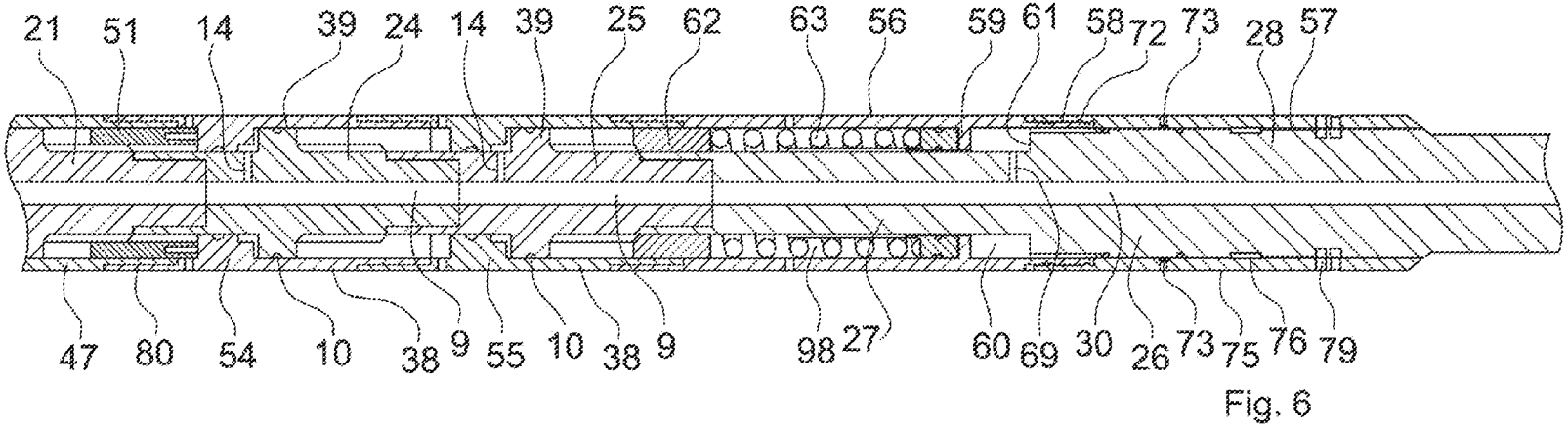
Figure 7:
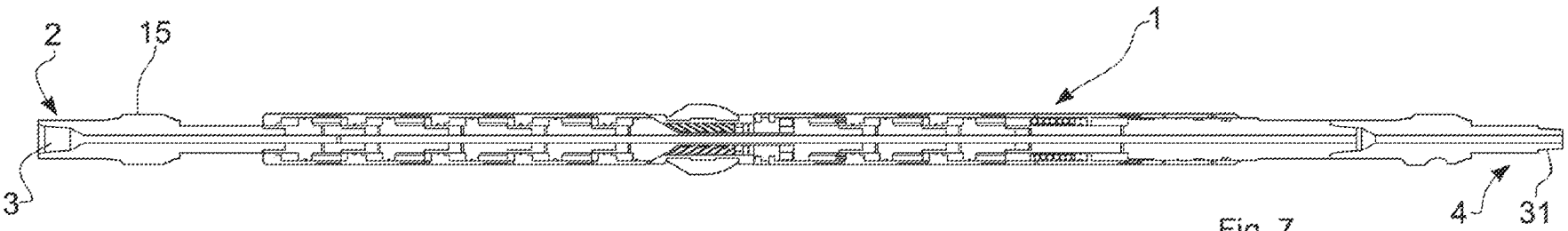
FIG. 7 shows a tool embodying the present invention in a second configuration.

FIG. 6 shows a zoomed-in view of the tool of FIG. 1, extending between the lines indicated by E and F in FIG. 1. The lower end of the stop component 21 can be seen at the left-hand end of FIG. 6.

At its lower end, the stop component 21 is connected to a fifth piston inner 24. The fifth piston inner 24 is, in turn, connected to a sixth piston inner 25 at its lower end.

The fifth and sixth piston inners 24, 25 are preferably identical or substantially identical to the second to fourth piston inners 11-13 shown in FIG. 2. Each includes an outwardly upper protruding flange 10 near its top end, a central flow bore 9 passing along its length, and a communication port 14 extending from the flow bore 9 to the exterior of the piston inner, at a level above the flange 10.

At its lower end, the sixth piston inner 25 is connected to a lower connection body 26. An upper region 27 of the lower connection piece 26 has a relatively small diameter, and a lower region 28 of the lower connection body 26 has a greater diameter.

At its bottom end, the lower connection body 26 is connected to a bottom connection piece 29, which carries the threaded connection at the lower end 4 of the tool. The bottom connection piece 29 has a centraliser 77 partway along its length, similar to the upper connection piece 5.

The lower body 26 and bottom connection piece 29 have flow bores 30 passing along their length.

All of the components described above are fixed to one another and, in use of the tool 1, will not substantially move longitudinally with respect to one another. The distance between the upper and lower threaded connections 3, 31 will not change during use of the tool 1. Each of the components has a central flow bore, and these bores align with one another to form a continuous or substantially continuous flow bore passing along the length of the tool 1, from the top end 2 to the bottom end 4 thereof.

The components described above together form a rigid or substantially rigid supporting stem of the tool 1, which may be referred to as a mandrel.

A series of further components will be now be described, which, in use, are movable with respect to the mandrel.

Returning to FIG. 2, a first piston outer 32 is positioned around the first piston inner 7. The first piston outer 32 has an elongate sleeve portion 34, which is preferably generally cylindrical, and has an inward-facing flange 33 at its top end. The inward-facing flange 32 is positioned above the protruding flange 10 of the first piston inner 7. The sleeve portion 34 of the first piston outer 32 is sufficiently large that it can fit over, and slide with respect to, the radial flange 10 of the first piston inner 7. The inward-protruding flange 33 of the first piston outer has an inner diameter which is smaller than the outer diameter of the flange 10 of the first piston inner 7, however.

An O ring or similar seal 35 is provided between the outer surface of the radial flange 10 of the first piston inner 7 and the sleeve portion 34 of the first piston outer 32.

A first chamber 36 is formed between the outer surface of the first piston inner 7, in the region below the flange 10 thereof, and the inner surface of the sleeve portion 34 of the first piston outer 32. The communication port 16 of the first piston inner 7 allows fluid flow between the flow bore 9 and the first chamber 36.

At its lower end, the first piston outer 32 is connected to a second piston outer 37. The second piston outer once again has a sleeve portion 38, and an inward-facing flange 39 near its top end, which is positioned above the outward-protruding flange 10 of the second piston inner 11.

A second chamber 40 is, in a similar manner to that described above, formed between the outer surface of the second piston inner 11, in the region below the outwardly protruding flange 10 thereof, and the inner surface of the sleeve portion 38 of the second piston outer 37.

Where the communication port 14 of the second piston inner 11 meets the outer surface thereof, a recess 41 is formed in the flange 39 of the second piston outer 37.

At its lower end, the second piston outer 37 is connected to a third piston outer 42, which is identical or generally identical to the second piston outer 37. At its lower end, the third piston outer 42 is connected to a fourth piston outer 43, which is once again identical or substantially identical to the second piston outer 37.

At its lower end, the fourth piston outer 43 is connected to a blade housing 44. The blade housing 44 can be seen at the right-hand end of FIG. 2, and at the left-hand end of FIG. 3. The blade housing 44 is generally hollow and cylindrical in profile, and surrounds the blade carrier 17. With reference to FIG. 4, as discussed above, the blade carrier 17 has four pockets 19 formed therein. The blade housing 44 similarly has pockets 45, comprising gaps in the blade housing 44, which align with the pockets 19 of the blade carrier 17. The pockets 45 extend, in the example shown in the figures, along a significant portion of the length of the blade housing 44.

At its lower end, the blade housing 44 surrounds the stop component 21, and comprises a drive sleeve 47, which surrounds and is connected to one or more travelling blocks 48.

Figure 5:
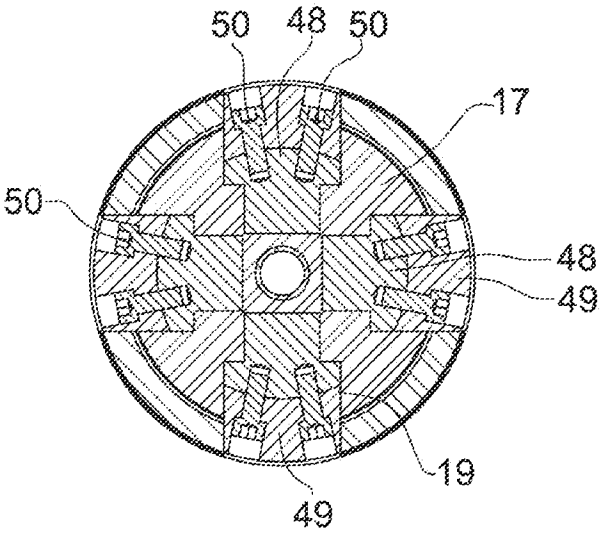
FIGS. 4 and 5 are cross-sectional views through the tool of FIG. 1.

FIG. 5 shows a cross-sectional view through the tool 1, at the position marked by H in FIG. 3. As can be seen in FIG. 5, the blade carrier 17 extends into regions between the travelling blocks 48. The travelling blocks 48 are arranged in the pockets 19 in the blade carrier 17. As can be understood from FIGS. 4 and 5, the pockets 19 extend along the blade carrier 17 and through the positions marked by G and H in FIG. 3. One travelling block 48 is received in each pocket 19.

The travelling blocks 48 are joined to the drive sleeve 47, and in the example shown this is done by the provision of inserts 49, which pass through and are connected to both the drive sleeve 47 and the travelling blocks 48. In the example shown, two sets of inserts 49 are provided, i.e. an upper set and a lower set. The upper and lower sets of inserts 49 are axially spaced apart from each other. In each set of inserts 49, one insert 49 is provided to connect each travelling block 48 to the drive sleeve 47. There are therefore eight inserts 49 altogether.

The inserts 49 are joined to the travelling blocks 48 in any suitable way. In the example shown, a pair of screws 50 is threaded into suitable apertures which are formed in each insert 49 and each travelling block 48.

A stop ring 51 is attached to the inner side of the drive sleeve 47 at its lower end. In the configuration shown in FIG. 3, a gap 52 is initially present between the top end of the stop ring 51, and the rearward-facing shoulder 53 formed by the lower side of the protruding flange 22 of the stop element 21.

At its lower end, the drive sleeve 47 is attached to a fifth piston outer 54. At its lower end, the fifth piston outer 54 is attached to a sixth piston outer 55. The fourth and fifth piston outers 54, 55 are identical or substantially identical to the second to the fourth piston outers 37, 42, 43, and surround the fifth and sixth piston inners 24, 25 respectively. Each has a sleeve portion 38, and an inward facing flange 39.

At its lower end, the sleeve portion 38 of the sixth piston outer 55 is attached to an intermediate sleeve portion 56, which surrounds an upper part of the lower connection body 26. The intermediate sleeve portion 56 is in turn attached at its lower end to a lower sleeve portion 57, for instance by a threaded connection 58. The lower sleeve portion 57 surrounds a middle part of the lower connection body 26. The lower connection body 26 protrudes, in the example shown, downwardly below the lower end of the lower sleeve portion 57.

The further components described above (i.e. the first to sixth piston outers 32, 37, 42, 43, 54, 55, the blade housing 44, the intermediate sleeve portion 56 and the lower sleeve portion 57) are connected to one another, and are movable with respect to the components that formed a mandrel. These components are referred to collectively below as the outer sleeve components, or simply the outer sleeve, of the tool 1.

With reference to FIG. 6, the intermediate sleeve portion 56 has an inwardly-protruding support ring 59, which is preferably positioned towards its lower end. The support ring 59 extends towards the outer surface of the upper region 27 of the lower connection body 26, but does not contact the lower connection body 26, such that there is a gap between these components. A drive chamber 60 is defined between the lower surface of the support ring 59 and the upward-facing shoulder 61 which is created by the change in width between the upper and lower regions 27, 28 of the lower connection body 26.

A communication port 69 extends between the main flow bore 30 of the lower connection body 26 and the drive chamber 60.

A floating piston ring 97 is positioned above the support ring 59, and is free to move upwardly and downwardly with respect both to the lower connection body 26 and the intermediate sleeve portion 56. The piston ring 97 preferably fills or substantially fills the space between the lower connection body 26 and the intermediate sleeve portion 56, and has O rings or other seals to form reliable seals against these components.

In the example shown, a sleeve 98 extends upwardly from the inner side of the piston ring 97, lying adjacent or against the outer surface of the lower connection body 26.

A bracing ring 62 is connected to the outer surface of the top end of the upper region 27 of the lower connection body 26. The bracing ring 62 is fixed in place with respect to lower connection body 26, and therefore forms part of the mandrel. In the configuration of the tool 1 shown in FIGS. 1-6, there is a gap between the top end of the sleeve 98 and the bracing ring 62.

A spring 63 (or other suitable resilient element) is positioned between the outer surface of the upper region 27 of the lower connection body 26, and the interior of the intermediate sleeve portion 56. The spring 63 is braced at its upper end against the lower side of the bracing ring 62, and its lower end against the piston ring 97. The sleeve 98 of the piston 97 lies inside the spring 63.

The configuration of the tool 1 shown in FIGS. 1-6 is a first configuration, in which the tool will be initially placed to be run in hole. In this configuration, the outer sleeve components are moved as far downwardly with respect to the mandrel as possible. This downward motion is, in the example shown, limited by contact between the lower side of the travelling blocks 48 and the upper side of the stop component 21. This need not be the case, and in other embodiments downward motion could be limited by contact between, for example, the upper surfaces of the radial flanges 10 of the first to sixth piston inners 7, 11-13, 24, 25, and the lower surfaces of the inward-facing flanges 39 of the first to sixth piston outers 32, 37, 42, 43, 54, 55. In the example shown, when the outer sleeve is at the limit of its downward motion with respect to the mandrel, a small gap is present between the flanges of the piston inners and outers, and this allows for some manufacturing tolerance in these components.

The outer sleeve components may move upwardly with respect to the mandrel, and the extent of this motion is, in preferred embodiments, limited by the stop component 21. As the outer sleeve components move upwardly with respect to the mandrel, the top end of the stop ring 51 will contact the downward-facing shoulder 53 of the flange of the stop element 21. The movement of the outer sleeve components with respect to the mandrel is therefore limited in both the upward and downward directions.

First to fourth blades 64 are carried by the blade carrier 17. Each blade 64 is received in one of the pockets 19 of the blade carrier 17, but is not attached to the blade carrier 17, and is able to move both axially and radially with respect to the blade carrier 17.

At least a part of the inward-facing walls 65 of each pocket 19 have slanting ribs 66 formed thereon, as can be seen in FIGS. 3 and 4.

Figure 15:
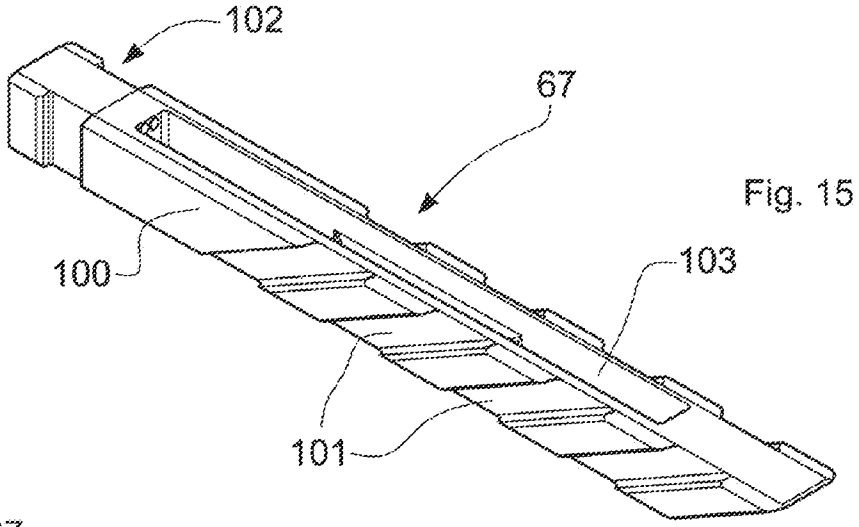
FIG. 15 shows a blade body suitable for use with the invention, in isolation.

Each blade 64 comprises a blade body 67, shown in isolation in FIG. 15, which preferably takes the form of a block received between the inward-facing walls 65 of the respective pocket 19. The outer side surfaces 100 of the blade body 67 have slanting grooves 101 formed on them, into which the ribs 66 are received.

The slant of the ribs 66 and grooves 101 is such that, as the ribs 66 slide along the grooves 101, the blade 64 moves radially outwardly with respect to the mandrel, and also upwardly towards the top end 2 of the tool 1.

Each blade 64 further comprises a cutting portion 68, which is fixed to the outward-facing side of the blade body 67. The cutting portion 68 may have a relatively sharp cutting edge, although this need not be the case. In the view shown in FIG. 15 the cutting portion 68 is not present, and an aperture 103 can be seen in the top of the blade body 67, in which the cutting portion 68 is received when it is attached.

In the example shown, the cutting portion 68 of each blade 64 is removably attached to the respective blade body 67. This means that, if a cutting portion 68 is damaged or worn, it can be removed and replaced without the blade body 67 also needing to be replaced. This arrangement also allows the blade body 67 and cutting portion 68 to be formed from different materials which are best suited to their tasks. In other embodiments this need not be the case, and for example the body 67 and cutting portion 68 of each blade 64 may be integrally formed as a single unit.

At their lower ends, the blade bodies 67 are attached to the top end of the respective travelling blocks 48. In preferred embodiments, the lower end of each blade body 67 has a T-shaped protrusion 102, which can be seen in FIG. 15, and cooperating T-slots are formed in the top sides of the travelling blocks, and also optionally in the upper set of inserts 49. As the skilled reader will understand, this arrangement will allow the blade bodies 67 to slide radially inwardly and outwardly with respect to the travelling blocks 48, but will also fix the blade bodies 67 to the travelling blocks 48 in the axial direction.

As mentioned above, the configuration shown in FIGS. 1-6 is a first configuration, in which the blades 64 of the tool 1 are retracted. As can be seen in FIG. 4, in this configuration the outer tips of the cutting portions 68 of the blade 64 do not protrude outwardly beyond the cross-section of the blade housing 44.

Operation of the tool 1 will now be described.

As discussed above, the tool 1 comprises first to sixth piston inners 7, 11-13, 24, 25, and respective first to sixth piston outers 32, 37, 42, 43, 54, 55. Each piston inner and respective piston outer together form a piston, and for convenience these pistons will be referred to below as the first to sixth pistons. It should be understood that the first piston is composed of the first piston inner 7 and the first piston outer 32, and so on.

The tool 1 is incorporated into a drill string, and will be connected to other tools in the drill string via the upper and lower threaded connections 3, 31. The tool 1 is initially in the first configuration, as shown in FIGS. 1-6.

Once the tool 1 is at the required depth in the well bore, the tool 1 may be activated, to move into a second configuration, which is shown in FIGS. 7 to 12. The views in FIGS. 7 to 12 correspond generally to the views shown in FIGS. 1 to 6, respectively.

In the example shown in the figures, activation is initiated by increasing the fluid pressure in the flow bore passing along the centre of the tool 1.

With reference to FIG. 6, one consequence of this will be that pressurised fluid flows through the communication port 69 and into the drive chamber 60. This fluid pressure will be communicated through the gap between the support ring 59 and the lower connection body 26, and tend to drive against the lower side of the floating piston ring 97, and hence push the piston ring 97 upwardly with respect to the mandrel. This will have the effect of compressing the spring 63, which is positioned between the bracing ring 62 and the piston ring 97. At this stage there will be a gap between the floating piston ring 97 and the support ring 59. The effect of the spring 63 is to drive the outer sleeve downwardly with respect to the mandrel, i.e. to retain the tool 1 in the first configuration, and introducing pressurised fluid into the drive chamber 60 in this way helps to stop the spring 63 from preventing the tool 1 from moving into its activated configuration.

The upward motion of the piston ring 97 is halted when the top of the sleeve 98 contacts the bracing ring 62. The length of the sleeve 98 is chosen so that the spring 63 is not over-compressed as the tool is activated.

Figure 8:
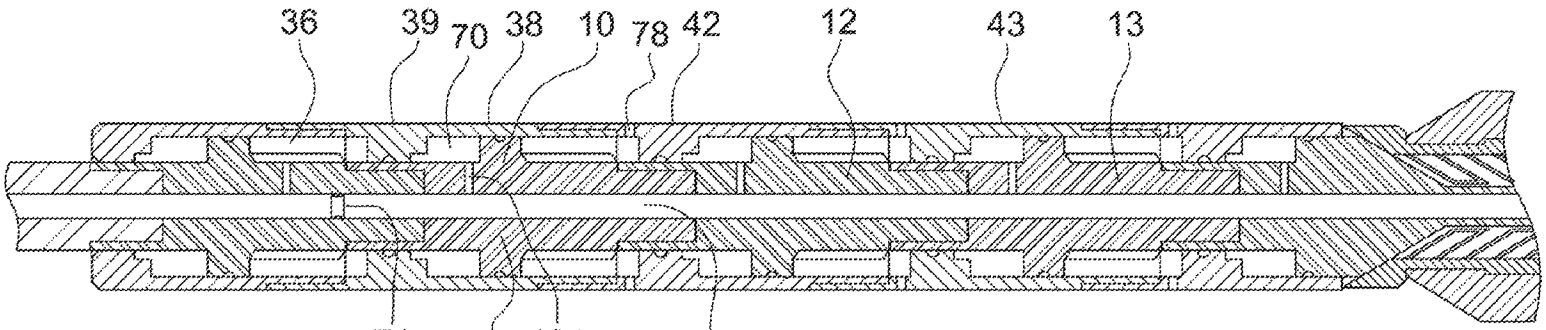
FIGS. 8, 9 and 12 are more detailed images of parts of the tool of FIG. 7.

With reference to the second piston, as can be seen most clearly in FIG. 8, a drive chamber 70 is defined on its inner side by the outer surface of the second piston inner 11, above the protruding flange 10, on its outer side by the inner side of the sleeve portion 38 of the second piston outer 37, on its upper side by the lower side of the inward-protruding flange 39 of the second piston outer 37, and on its lower side by the upper side of the outward-protruding flange 10 of the second piston inner 11. The communication port 14 of the second piston inner allows pressurised fluid to flow from the central flow bore 9 into the drive chamber 70.

As pressurised fluid enters the drive chamber 70, the effect will be to force the second piston outer 37 upwardly with respect to the second piston inner 11. As this happens, the volume of the second chamber 40 will decrease, and fluid will flow from the second chamber 40 into the annulus through one or more vent ports 78. In the example shown, the vent ports 78 are formed in an upper part of the sleeve portion 38 of the third piston outer 42.

The skilled reader will understand that each of the third to sixth pistons will likewise form a drive chamber 70, into which pressurised fluid will flow from the main flow bore 9, and which will also generate a force to drive the respective piston outer upwardly with respect to the piston inner.

As pressurised fluid is introduced into the tool 1, the overall effect of the second to sixth pistons will be to drive the outer sleeve components upwardly with respect to the mandrel.

Figure 9:
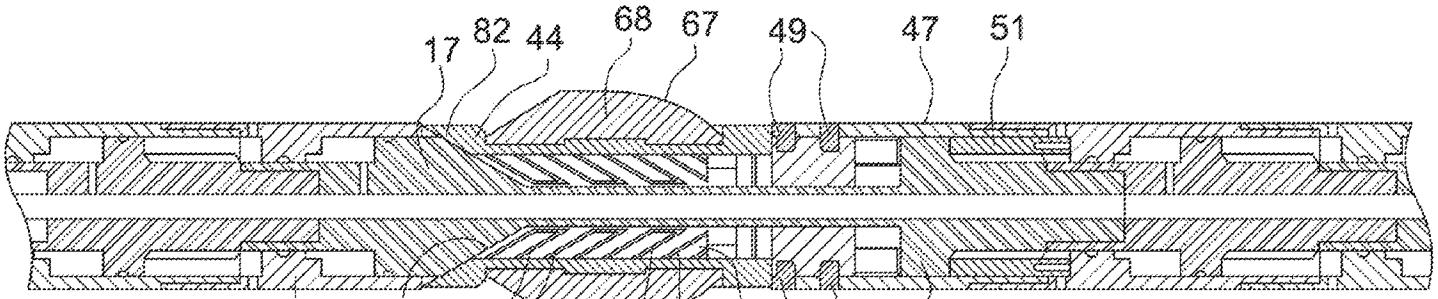
Figure 11:
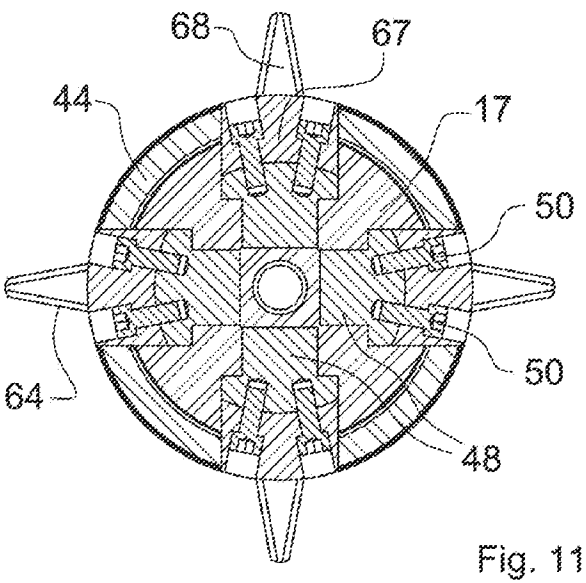
FIGS. 10 and 11 are cross-sectional views through the tool of FIG. 7.

With regard to FIG. 9, the travelling blocks 48, which are connected to the drive sleeve 47 by the inserts 49, will also be driven upwardly. As discussed above, the travelling blocks 48 are attached to the blade bodies 67 of the blades 64, and so the blades 64 are driven upwardly with respect to the blade carrier 17. As this occurs, the ribs 66 will cause the blades 64 to move radially outwardly with respect to the longitudinal axis of the tool 1, as can be seen in FIG. 9.

Figure 16:
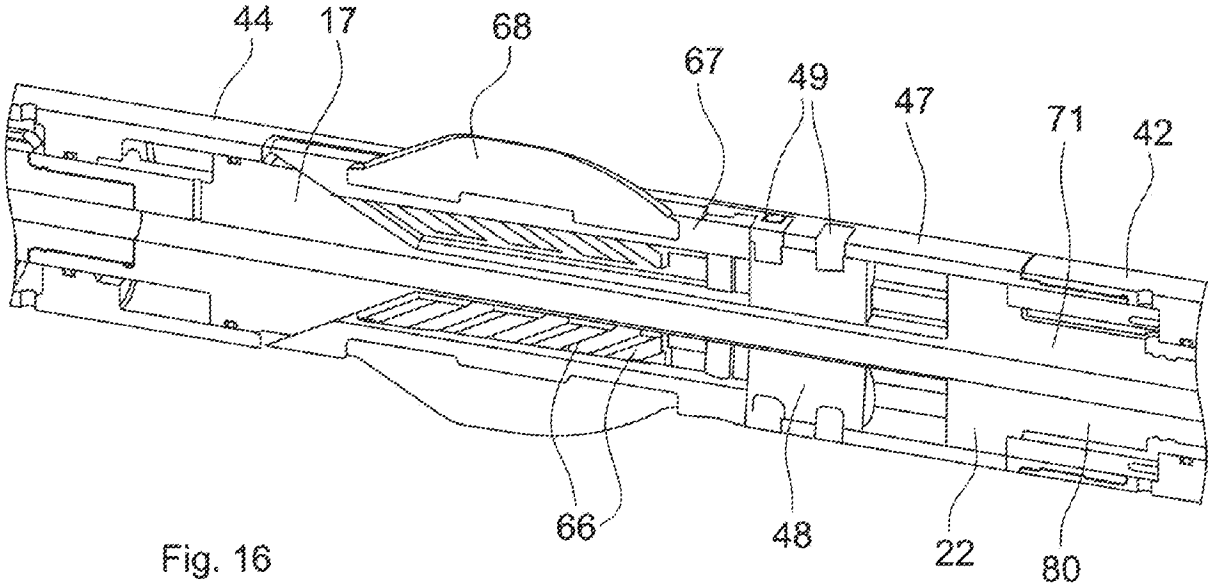
FIG. 16 shows a perspective view, similar to the view shown in FIG. 9.

FIG. 16 shows similar components to FIG. 9, but is a perspective view.

Figure 10:
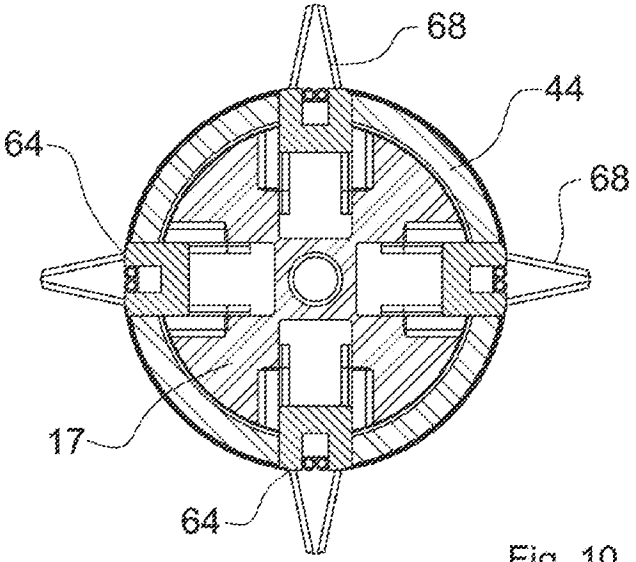

With reference to FIG. 10, it can be seen that the cutting portions 68 of the blades 64 protrude outwardly beyond the blade housing 44.

The cumulative force generated by the second to sixth pistons therefore acts to drive the blades 64 outwardly from the tool 1, so that they can perforate a casing (not shown) surrounding the tool 1. A large outward radial force will therefore be imparted to the blades 64, enabling them to break a relatively thick and strong casing.

As can be seen in FIGS. 3 and 9, at its top end each blade body 67 has an inclined face, which slopes radially outwardly and upwardly. At the top end of each pocket 19, a corresponding inclined face 82 is formed, and this inclined face 82 is preferably set at the same, or substantially the same, angle as the inclined face 81 at the top end of the corresponding blade body 67. These inclined faces 81, 82 are also preferably set at the same, or substantially the same, angle as the slanting ribs 66 of the blade carrier 17 and cooperating slanting grooves formed on the blade bodies 67.

As the blades are expanded and brought into contact with the casing, the inclined face 81 of the blade body 67 slides over the inclined face 82 at the top of the pocket 19. This provides a large bearing surface area between these components, and helps to guide the blades 64 outwardly in a sturdy and reliable manner.

The upward motion of the outer sleeve components with respect to the mandrel is halted by the stop ring 51 contacting the downward-facing shoulder 53 of the flange 22 of the stop component 21.

During activation of the tool 1, applying a downward force on the drill string from the surface (or fully or partially releasing the drill string so that downward forces act through gravity) may help to dig the blades further into the casing, as this will lead to further relative downward motion of the mandrel with respect to the outer sleeve. If this technique is to be used, it may be beneficial to shape the leading edge of each blade so that the downward force applied to the mandrel does not act to retract the blades. The skilled reader will appreciate how this may be achieved.

A further effect of the second to sixth pistons driving the outer sleeve upwardly with respect to the mandrel will be that the intermediate sleeve portion 56 will move upwardly, and the support ring 59 will therefore also move upwardly. The support ring 59 may abut against the lower side of the piston ring 97.

The skilled reader will note that, in the example shown in the figures, the first piston works in opposition to the motion generated by the second to sixth pistons. When pressurised fluid is introduced in the flow bore of the tool 1, it will flow through the communication port 16 of the first piston inner 7, and into the first chamber 36, which is best seen in FIGS. 2 and 8. The first chamber 36 is bounded at its top side by the bottom side of the flange 10 of the first piston inner 7, and at its bottom side by the top side of the inward-protruding flange 39 of the second piston outer 37. As pressurised fluid is introduced into the first chamber 36, the effect will tend to be to drive the outer sleeve components downwardly with respect to the mandrel.

During activation of the tool 1, the first piston will at least partly counteract the effect of the second piston. In this embodiment, therefore, the upward motion of the outer sleeve components with respect to the mandrel will effectively be driven by the third to sixth pistons.

However, the first piston may be used in the deactivation of the tool 1, i.e. in moving the tool 1 from the second or activated configuration back to the first configuration, in which the blades 64 are retracted.

With reference to FIG. 2, a ball seat 71, which in the illustrated example takes the form of a narrowed portion of the flow bore 9, is provided in the first piston inner 7. The ball seat 71 is positioned below the communication port 16 of the first piston inner 7.

When operators wish to move the tool from the second configuration back to the first configuration, in the first instance the supply of pressurised fluid to the tool may be stopped. Once this has occurred, two separate forces will tend to return the tool to the first configuration. Firstly, since tool 1 is likely to be used with the top end 2 uppermost, the weight of the outer sleeve components will tend to drop under gravity with respect to the mandrel, thus returning the tool to the first configuration. Secondly, the spring 63 will tend to drive the sleeve components downwardly with respect to the mandrel, once again returning the tool to the first configuration.

As discussed above the blade bodies 67 are axially connected to the respective travelling blocks 48, through the T-shaped protrusions 102 and the corresponding T-shaped slots. As the travelling blocks 48 move downwardly with respect to the mandrel, therefore, this will act to pull the blades 64 downwardly, into their retracted positions.

In some circumstances, however this combination of forces may not be sufficient to retract the blades 64. If the blades 64 have been driven forcefully into a wellbore casing, the blades 64 may be held relatively firmly in place with respect to the casing, and the effects discussed above may not generate sufficient force to retract the blades 64.

A further action that can be taken to retract the blades 64 is to pull the drill string upwardly with respect to the casing. If the blades 64 are stuck in the casing, then the blades 64 will remain substantially axially fixed with respect to the casing, while the mandrel (which is rigidly connected to the other components of the drill string) moves upwardly. This will tend to cause the blades 64 to be retracted, due to the slanting cooperating ribs 66 and grooves 101 of the pockets 19 and blades 64.

Where one or more blades 64 are very firmly stuck in the casing, this may be not sufficient to cause the blades 64 to retract.

In this case, a ball (not shown) may be dropped through the drill string and into the top end 2 of the tool 1, and come to rest on the ball seat 71. The effect of this will be to block fluid flow through the main flow bore of the tool 1, below the level of the ball seat 71.

Once the ball has been dropped and received in the ball seat 71, pressurised fluid may be introduced into the tool 1. As the skilled reader will appreciate, the pressurised fluid will be able to flow through the communication port 16 of the first piston inner 7, and into the first chamber 36. As can be understood from FIG. 8, the effect of this will be to drive the outer sleeve components downwardly with respect to the mandrel.

Because of the presence of the ball in the ball seat 71, the pressurised fluid will not be received by any of the second to sixth pistons. Therefore, the force generated by the first piston will not be opposed by any of the other pistons.

The result of introducing pressurised fluid to the first piston only will provide a large force to return the tool to the first configuration, and withdraw the blades 64 from a casing in which they may be embedded.

While the first piston counteracts the effects of the second to sixth pistons during the activation process, the return effect provided by the first piston may be very valuable in some applications, and will justify the effect of the first piston during the activation process.

Once the tool 1 has been returned to the first configuration, the ball may be removed from the seat 71, for instance by increasing the pressure until the ball is extruded through the seat 71. The ball may be caught by a suitable ball catcher (not shown) provided in the tool 1 or in another component of the drill string, or may simply pass out of the bottom of the tool 1. The tool 1 is then ready to be activated again, if necessary.

In other embodiments, the first piston may be omitted, and all of the pistons which are formed as part of the tool 1 may generate a force, when pressurised fluid is introduced into the tool 1, that tends to move the sleeve components upwardly with respect to the mandrel.

Figure 12:
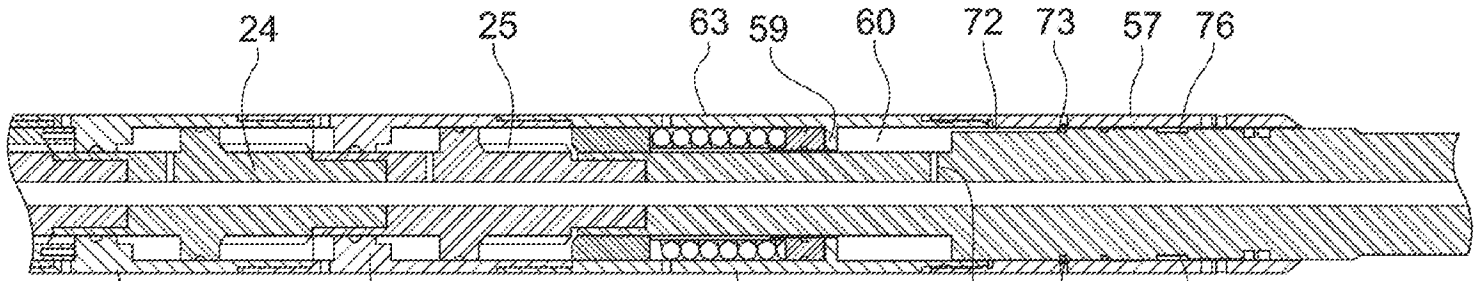

With reference to FIGS. 6 and 12, some further details of the lower end of the tool 1 will now be described.

As can be seen in FIG. 6, two vent passages 72 extend downwardly from the drive chamber 60 that is defined partly by the lower connection body 26. The vent passages 22 extend from the drive chamber 60 along an outer surface of the lower connection body 26, and preferably each takes the form of a groove or trough on the outer surface of the lower connection body 26.

In the first configuration, shown in FIG. 6, the vent passages 72 do not axially align with any further flow passages. The vent passages 72 therefore terminate in dead ends. When pressurised fluid is first introduced into the drive chamber 60, when the tool 1 is in the first configuration, the pressurised fluid will enter the vent passages 72, but will not be communicated further from the vent passages 72.

A communication groove (not shown in FIG. 6) runs around the exterior of the lower connection body 26. Two vent ports 73 are formed through the lower sleeve portion 57, and are axially aligned with, and in fluid communication with, the communication groove. However, in the first configuration shown in FIG. 6, the vent ports 73 are lower than the vent passages 72.

While two vent passages 72 and two vent ports 73 are shown in the figures, further vent passages and vent ports may be provided. In alternative embodiments, only one vent passage and vent port may be included.

When the tool 1 is activated, and fully moved into the second configuration (i.e. to the end of its range of motion), as seen in FIG. 12, the communication groove aligns with the end of the respective vent passages 72, and pressurised fluid may then flow from the drive chamber 60, through the vent passages 72 and the vent ports 73, to the annulus. The formation of a communication groove which extends around the exterior of the lower connection body 26 means that the vent passages 72 do not need to be radially aligned with the vent ports 73.

As the tool 1 reaches its full stroke, i.e. the sleeve components have moved upwardly by their maximum extent with respect to the mandrel, this will lead to a distinct and measurable drop in pressure within the tool 1, which can be detected from the surface and can let operators at the surface know that the tool 1 is fully activated.

In the example shown in the figures, a number of O rings are provided between the lower connection body 26 and the lower sleeve portion 57, to help form an effective seal between these components. One of these O rings 74 is positioned such that, during the movement of the tool 1 from the first configuration to the second configuration, the vent port 73 will pass directly over the O ring 74, thus exposing the O ring 74 to fluid from the annulus. It is possible that, in the course of this process, the O ring 74 may be damaged.

Positioned between the lower connection body 26 and the lower sleeve portion 57, in a recess 75 formed in the outer surface of the lower connection body 26, is a supply of further O rings 76. In use of the tool 1, these O rings 76 need not provide a sealing function. However, when the tool 1 has been recovered from the well bore after a trip into the wellbore, the lower sleeve portion 57 may be disconnected from the intermediate sleeve portion 56 (in the example shown, by undoing a threaded connection between these components) and slid downwardly with respect to the mandrel. This will allow operators to access the further O rings 76 in the recess 75, and use one of these O rings 76 to replace the O ring 74 which may have been damaged during activation or deactivation of the tool 1.

The further O rings 76 are positioned such that they can be accessed once a single component of the tool 1 has been disconnected and moved, where this procedure is relatively straightforward.

Once the O ring 74 has been replaced by one of the further O rings 76, the lower sleeve portion 56 may be re-attached to the tool 1.

One or more shear pins or other frangible components may be provided to hold the mandrel and the outer sleeve components in place with respect to each other before the tool 1 is ready to be activated. In the example shown, shear pins 79 are initially provided to form a connection between the lower sleeve portion 57 and the lower connection body 26, as can be seen in FIG. 6. When the tool is to be activated, and fluid above an activation pressure is introduced into the tool 1, the resulting forces will break the shear pins 79 (as can be seen in FIG. 12) to allow operation of the tool 1.

Figure 13:
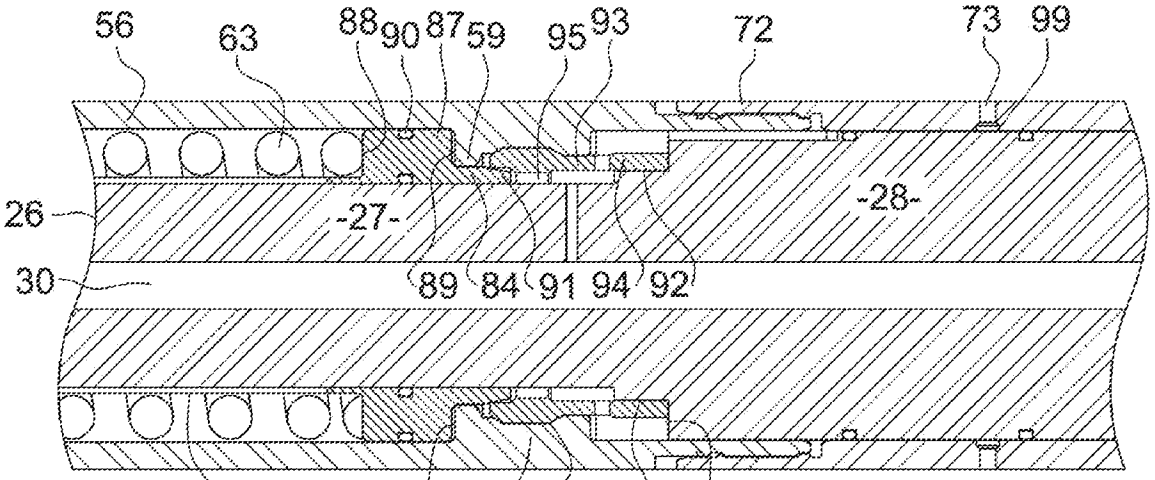
FIG. 13 shows a portion of an alternative tool in a first configuration.
Figure 14:
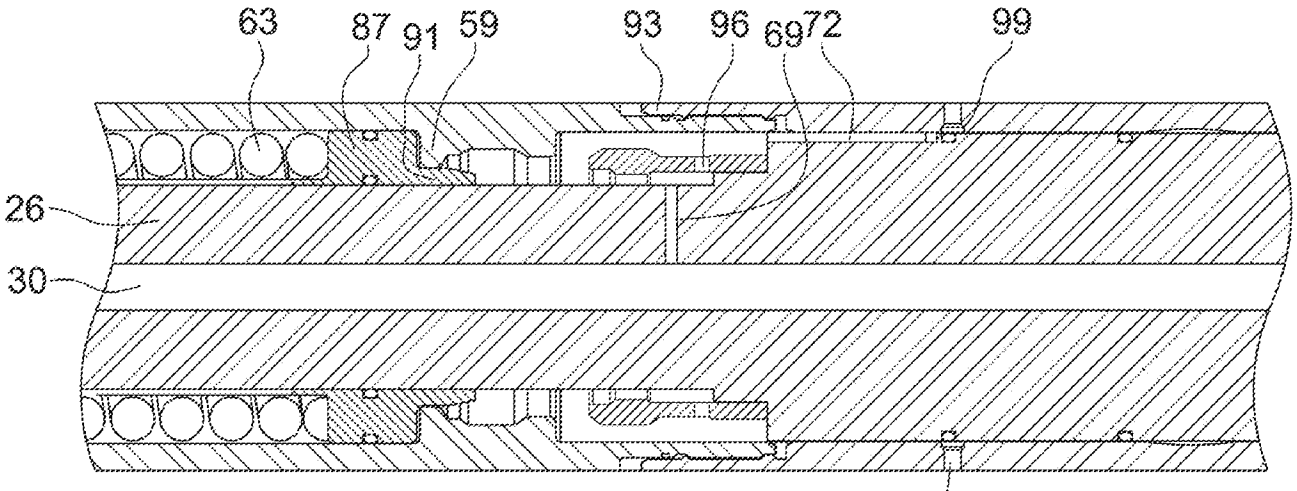
FIG. 14 shows the portion of the alternative tool in a second configuration.

With reference to FIGS. 13 and 14, a modified version of the tool is shown. FIGS. 13 and 14 show a region of the tool in the region of the bottom end of the spring 63, corresponding to a part of the view that can be seen in FIGS. 6 and 12.

As can be seen in these figures, the support ring 59 protrudes inwardly from the intermediate sleeve portion 56. In this embodiment, the support ring 59 has a longer axial extension than in the example shown in FIGS. 1-12. With reference to the lower side of FIG. 13, the support ring 59 presents a drive surface 83 at its top end, which faces generally upwardly towards the top end 2 of the tool 1. As in the example shown in FIGS. 1-12, a gap 84 is present between the inner side of the drive surface 83 and the outer surface of the lower connection body 26.

Below the drive surface 83, the support ring 59 comprises an elongate holding section 85. The holding section 85 does not protrude inwardly as far towards the lower connection body 26 as the drive surface 83.

The holding section 85 has an inward-facing recess 86 formed part way along its length.

A modified floating piston ring 87 is positioned between the drive surface 83 of the support ring 59 and the lower end of the spring 63. The piston ring 87 generally takes the form of a ring, presenting an upward-facing surface 88 on which the lower end of the spring 63 rests, and a downward facing surface 89 which abuts against the drive surface 83. In the example shown the piston ring 87 has inner and outer O rings 90 or similar seals so that its inner and outer surfaces seal effectively against the inner side of the intermediate sleeve portion 56 and the outer side of the lower connection body 26. As explained in connection with the previous embodiment, the piston ring 87 has a sleeve 98 extending upwardly from the inner side thereof, lying on the inner side of the spring 63.

In this example, the piston ring 87 also has a protrusion 91 which extends downwardly from an inner side of the main part of the piston ring 87. The protrusion 91 passes through the gap 84 between the lower connection body 26 and the drive face 83 of the support ring 59, and terminates in a position which is aligned with the recess 86 formed in the holding section 85 of the support ring 59.

The drive chamber 60 can also be seen in FIG. 13. As described above, a lower side of the drive chamber 60 is formed by the shoulder 61 formed where the upper and lower regions 27, 28 of the lower connection body 26 meet each other. On an inner side of the drive chamber 60, near this shoulder 61, a raised support is formed on the outer side of the upper section 27 of the lower connection body 26. The support 92 protrudes further towards the inner side of the intermediate sleeve portion 56.

A collet 93 takes the form of a generally cylindrical, hollow sleeve. A lower end 94 of the collet is positioned around the support 92, and is preferably axially fixed in place with respect to the support 92. An upper end 95 of the collet 93 protrudes upwardly beyond the support 92. As can be seen in FIGS. 13 and 14, there is a space between the inner side of the upper part 95 of the collet 93 and the outer surface of the lower connection body 26. The outer side of the upper part 95 of the collet 93 has a protruding shape, which generally matches the interior shape of at least part of, and optionally all or substantially all of, the recess 86 formed in the holding section 85 of the support ring 59.

The collet 93 is resilient, so the upper part 95 can deflect inwardly with respect to the lower part. To allow this to happen, the upper part 95 may be formed as a series of parallel fingers, with breaks between the fingers. The lower part 94 may be formed as a continuous ring, with each of the fingers being inwardly deflectable with respect to the ring.

FIG. 13 shows the first configuration of the tool, in which the outer sleeve is moved downwardly with respect to the mandrel as far as possible, and the blades are retracted. In this configuration, the upper part 95 of the collet 93 fits into the recess 85. As can also be seen in FIG. 13, the protrusion 91 of the piston ring 87 is positioned between the upper end 95 of the collet 93 and the outer surface of the lower connection body 26.

In this configuration, the collet 93 will prevent the outer sleeve from moving upwardly with respect to the mandrel. Forces may act on the outer sleeve which would tend to drive it upwardly with respect to the mandrel if, for instance, a part of the outer sleeve drags or snags against the interior of the wellbore as the tool is lowered downwardly through the wellbore.

If an upward force acts on the outer sleeve, the outer sleeve will not be able to move upwardly because the protruding shape of the upper part 95 of the collet 93 is fitted into the recess 86, and the abutting walls of the upper part 95 of the collet 93 and of the recess 86 will prevent the support ring 59 from moving upwardly with respect to the lower connection body 26.

Moreover, the upper part 95 of the collet 93 is prevented from deflecting inwardly, towards the lower connection body 26, by the presence of the protrusion 91 of the piston ring 87.

The collet 93 will therefore effectively lock the outer sleeve and mandrel together in the axial direction, in this configuration.

When the tool is activated, pressurised fluid flows from the flow bore 30 into the drive chamber 60, through the communication port 69. In preferred embodiments the collet 93 has apertures 96 formed there through, to ensure that pressurised fluid can flow effectively around the collet 93 and into the drive chamber 60.

As discussed above, the effect of pressurised fluid being introduced into the drive chamber 60 is to push the piston ring 87 upwardly with respect to the lower connection body 26, and compress the spring 63.

As this occurs the protrusion 91 will be withdrawn from the gap 84 between the support ring 59 and the lower connection body 26. The upper part 95 of the collet 93 will then no longer be prevented from deflecting inwardly towards the lower connection body 26. When the outer sleeve is driven upwardly with respect to the mandrel by the second to sixth pistons, the collet 93 can therefore deflect inwardly, out of the recess 86, allowing the support ring 59 to move upwardly past the upper part 95 of the collet 93. This is shown in FIG. 14.

To assist in this inward deflection, a downward-facing surface of the upper part 95 of the collet 93, and an upward-facing surface of the recess 86, may have cooperating bevelled surfaces (set, for example at 45° to the longitudinal axis of the tool).

When the tool is activated through the introduction of pressurised fluid, the collet 93 will therefore not prevent this activation.

When the tool is deactivated, to return it from the second configuration to the first configuration, the reverse process will occur. The intermediate sleeve portion 56 and the support ring 59 will move downwardly, and as the lower edge of the support ring 59 contacts the upper part 95 of the collet 93, the upper part 95 will deflect inwardly. To assist in this, the edges of these components that first contact each other may have bevelled edges, so that the upper part 95 of the collet 93 is deflected inwardly as the edges meet.

As the support ring 59 moves further downwardly, the protruding upper part 95 of the collet 93 will align with the recess 86, and the collet 93 will deflect so that the upper part 95 thereof is received in the recess 86.

The protrusion 91 of the piston ring 87 will then pass through the gap 84 between the support ring 59 and the lower connection body 26, and once again be positioned between the upper part 95 of the collet 93 and the outer surface of the lower connection body 26. The tool will then have returned to the first configuration shown in FIG. 13, and the outer sleeve and mandrel will once again be axially locked with respect to each other.

The skilled reader will appreciate how this arrangement effectively acts as a latch, locking the outer sleeve and mandrel together axially when the tool is in the first configuration, and allowing axial movement of the outer sleeve and mandrel when the tool is activated. Once the tool has been activated for a first time, any shear pins or the like will have been broken, and will no longer hold the sleeve in place with respect to the mandrel before subsequent activations. In some embodiments, the presence of a latch mechanism of this type may allow shear pins to be dispensed with altogether.

It is envisaged that is some embodiments, the collet 93 may have sufficient stiffness that the protrusion 91 which blocks inward motion of the upper part 95 of the collet 93 may be unnecessary. In these embodiments, a certain level of axial force acting on the outer sleeve is needed for the collet 93 to deflect inwardly and allow axial movement between the outer sleeve and the mandrel. The level of force is chosen to be such that, during movement of the tool within the wellbore the level of force is unlikely to be exceeded. However, when the tool is to be activated and pressurised fluid is introduced into the second to sixth pistons the level of force is exceeded and the collet 93 deflects inwardly to allow the outer sleeve to move axially with respect to the mandrel.

The communication groove 99 (discussed above) can also be seen in FIGS. 13 and 14.

Figure 17:
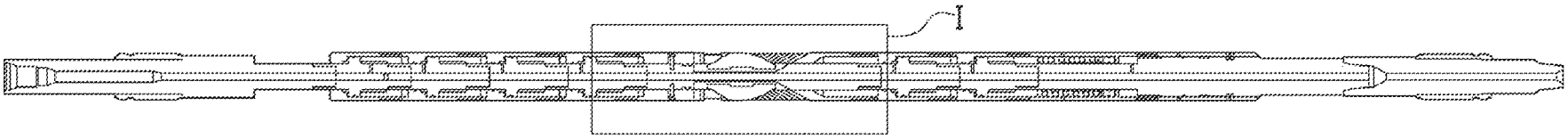
FIG. 17 shows a further alternate tool embodying the invention.
Figure 18:
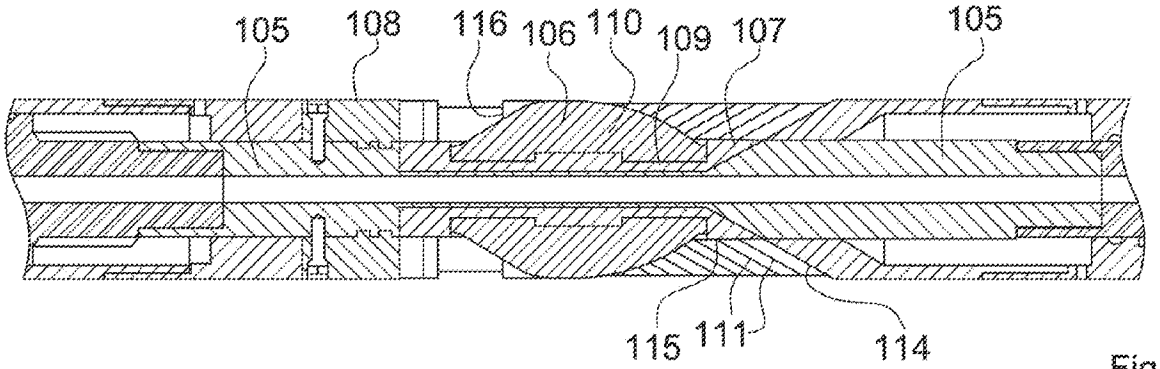
FIGS. 18 and 19 are detailed views of the region indicated by I in FIG. 17.
Figure 19:
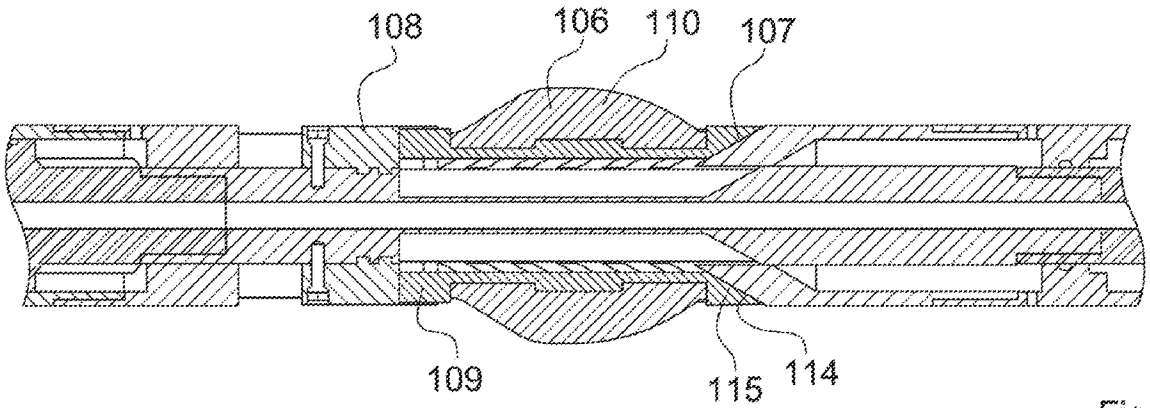

Referring to FIGS. 17-19, a further tool 104 embodying the invention is shown. The further tool 104 has many features in common with the tools described above, and only the different features will be described below.

FIG. 17 shows the entire tool 104. FIGS. 18 and 19 show zoomed-in views of the region indicated by I in FIG. 17.

Turning firstly to FIG. 18, this figure shows the components when the tool 104 is in the first configuration, with the blades retracted. A blade carrier 105 forms part of the mandrel of the tool 104, and again has pockets formed therein in which blades 106 are received. In this embodiment, the blade carrier 105 resembles the blade carrier 17 of the previous examples, but is arranged the other way up, so that it has an inclined face 107 formed below the blades 106. The travelling blocks are not present in this embodiment, and support blocks 108 are positioned above the blades 106. Each blade 106 is axially linked at its upper end to one of the support blocks 108, for instance through each blade 106 having a T-shaped protrusion (not shown), and corresponding T-shaped radial grooves being formed in the blade carrier 105 and/or in the support blocks 108. In this example the support blocks 108 are fixed in place with respect to the mandrel.

As before, each blade 106 comprises a blade body 109 and a cutting portion 110. At its lower end, each blade body 109 has an inclined face 115, which slants downwardly and outwardly with respect to the longitudinal axis of the tool 104. The slant of this inclined face 115 preferably matches that of the inclined face 107 of the blade carrier 105.

In this example the blade carrier 105 does not have grooves or ribs formed thereon. Instead, raised ribs 111 are formed on the inner sides of the pockets of the blade housing 112. In the example shown, the ribs 111 slant downwardly and outwardly, relative to the longitudinal axis of the tool 104. It can be seen in FIG. 18 that, in the region of the blades 106, the thickness of the blade housing 112 is greater than in previous embodiments.

The blades 106 have corresponding slanted grooves (not shown) formed on their outer surfaces. In the example shown the grooves are formed on the blade bodies 109 of the blades 106.

The tool 104 is activated in the same manner as described above. As this occurs, the outer sleeve, including the blade housing 112, is driven upwardly with respect to the mandrel. As the blade housing 112 moves upwardly, the blades 106 will be driven outwardly with respect to the mandrel, through the interaction of the ribs 111 and grooves. FIG. 19 shows the second configuration, in which the blades 106 are fully expanded.

In this example, as the blades 106 are expanded, they move radially or substantially radially outwardly with respect to the mandrel. The blades 106 preferably do not, or substantially do not, move axially with respect to the mandrel as this occurs.

It is envisaged that this will assist in breaking through a casing, as the outward force imparted to the blades 106 will act to cut directly through the casing, without also driving the blades axially with respect to the casing. The blades 106 will, in effect, need to cut though a smaller thickness of the material of the casing, because they move in a direction which is substantially perpendicular to the thickness of the casing.

At the lower end of each pocket in the blade housing 112, the blade housing 112 presents an inclined face 114, which is preferably set at exactly or substantially the same angle as the inclined face 115 of the blade bodies 109. As can be seen in FIG. 19, as the blades are expanded these inclined faces 114, 115 bear against each other, and as with the previous examples this increases the area available to transfer force to the blades 106.

The support blocks 108 allow the blades 106 to slide radially outwardly with respect thereto, with the T-shape protrusions of the blades 106 moving within the T-shaped grooves.

In this embodiment the stop component 21 had been omitted, and instead the upward travel of the outer sleeve is limited by contact between an upward-facing shoulder 115 of the blade housing 112 with the support blocks 108. However, this need not be the case.

The present invention also covers other techniques for driving a component such as a blade or cutter outwardly with respect to a mandrel of a tool, in such a way that the component moves radially outwardly, with no or substantially no axial movement, with respect to the mandrel. This can be achieved in any manner, and not just by relative axial movement of a mandrel and outer sleeve, as is the case in the examples disclosed above. For instance, a piston could be provided as part of the mandrel, or connected to the mandrel, such that a drive axis of the piston is perpendicular to the longitudinal axis of the mandrel. When the piston is activated, the component is driven radially outwardly with respect to the mandrel.

Aspects of the present invention therefore provide a downhole tool, comprising: a body, having a first connection to connect the tool to an immediately upper component in a drill string and to receive fluid from the immediately upper component, and a second connection to connect the tool to an immediately lower component in a drill string and to deliver fluid to the immediately lower component; a drive mechanism; and a component which is operable to be driven radially outwardly with respect to the body by the drive mechanism, such that the component does not or substantially does not move axially relative to the body during this motion. Preferably, the component is a blade or cutter.

Referring to FIGS. 20-24, a further tool 1000 embodying the invention is shown. The further tool 1000 has many features in common with the tools described above, and the description here will focus on the different features.

The arrangement discussed with reference to FIGS. 20-24 differs from the above described arrangements primarily in respect of the construction of the rigid or substantially rigid supporting stem of the tool, which as discussed may be referred to as a mandrel.

It is important to note that any of the above described arrangements may be modified to replace their disclosed mandrels with a mandrel according to the present arrangement. Moreover, features of the present arrangement may be modified in accordance with the teachings of the above arrangements.

In the above described arrangements, the mandrels each comprise a plurality of piston inners. In the present arrangement, in contrast, a plurality of the piston inners are replaced by a continuous element. In comparison, for example, to the tool of FIG. 1, the tool of the present arrangement comprises a single continuous element 1007 in place of the first to fourth piston inners 7-13. (In the present arrangement there are six pistons in place of the four pistons formed in part by the first to fourth piston inners 7-13, however, as discussed below, the present invention is in no way limited to the number of pistons provided). The single continuous element 1007 preferably takes the form of an activation shaft.

Figure 20:
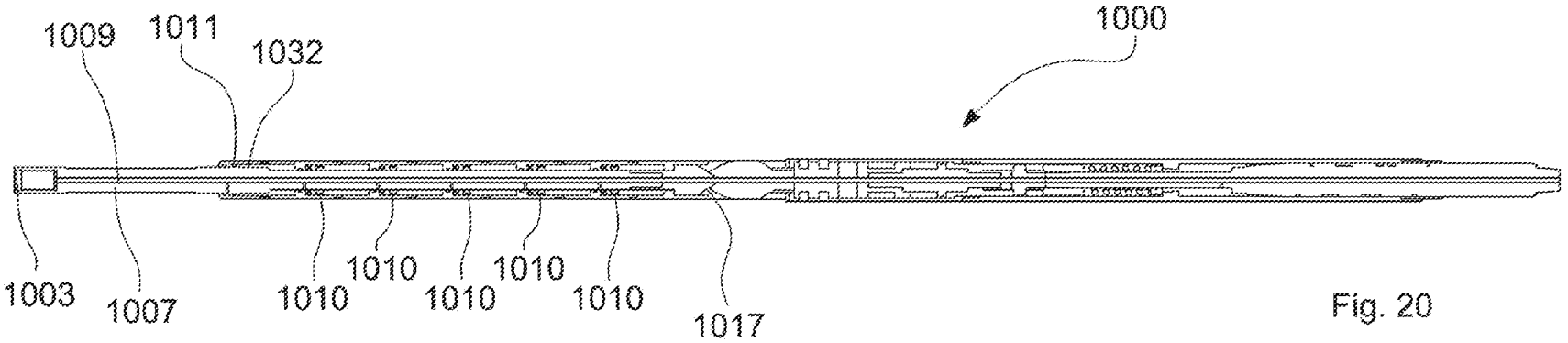
FIG. 20 shows a yet further tool embodying the invention in a first configuration.
Figure 21:
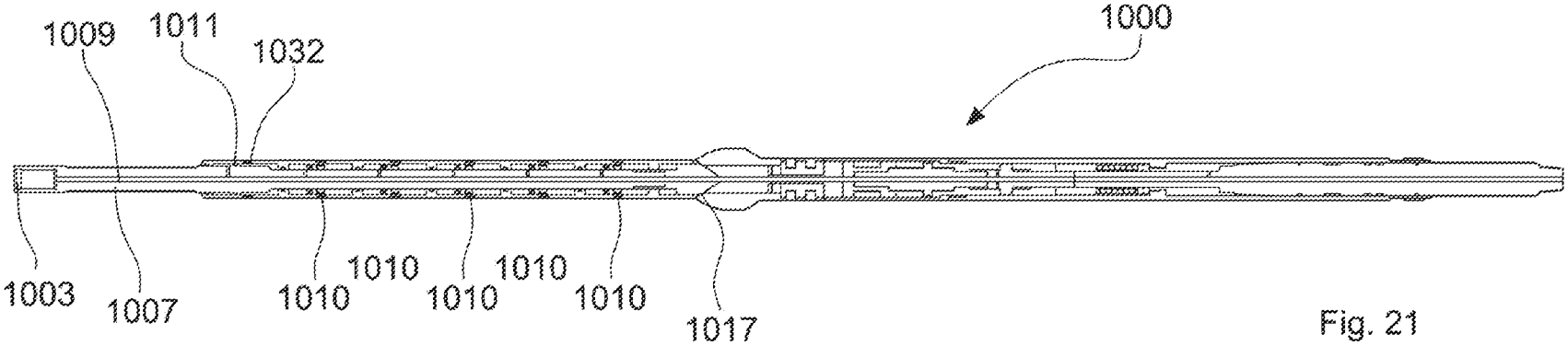
FIG. 21 shows the tool of FIG. 20 in a second configuration.

Considering the activation shaft 1007, this is generally cylindrical and provided with a central flow bore 1009, which passes therethrough. In place of the protruding radial flanges 10 of the piston inners 7-13 of the arrangement of FIG. 1, the activation shaft is provided with piston members 1010, which form the plurality of first protrusions extending outwardly from the inner body of the tool 1000. The piston members 1010, which may, as shown, take the form of rings attached to an outer surface of the activation shaft 1007, are described in further detail below. The activation shaft is provided with a plurality of communication ports 1014, which extend radially through the body of the activation shaft, and provide communication between the central bore 1009 and the exterior of the activation shaft 1007. The communication ports 1014 are provided at appropriate positions with respect to the piston members 1010. As can be seen in FIGS. 20 and 21, they are provided at positions above (i.e. closer to a top end of the tool 1000 than) the piston members 1010. Their positions may clearly be modified in accordance with modifications to the tool 1000.

In the present arrangement, in a region of a first piston outer 1032, the activation shaft 1007 is provided with a protruding radial flange 1011. It should be appreciated that in alternative arrangements this flange could be replaced with a piston member 1010, of similar construction to those provided lower down the activation shaft 1007 and described further below.

At its upper end, the activation shaft is provided with an upper threaded connection 1003 for connecting the tool 1000 to the next uppermost tool or component 1090 in the drill string. At its lower end, the activation shaft 1007 connects to a blade carrier 1017, which forms part of the component which is activated or operated by axial movement of the outer body of the tool 1000. The activation shaft 1007 thereby preferably extends continuously between the upper threaded connection 1003 and the component. It is preferably unitarily formed. The blade carrier 1017, and the component more generally, may be arranged in accordance with any of the above described arrangements.

The piston members 1010 of the present arrangement comprise rings that are attached to the activation shaft. The piston members 1010 are appropriately axially spaced from one another along the activation shaft 1007. The rings are each arranged to sealingly engage with the outer surface of the activation shaft 1007 and an inner surface of the outer body of the tool, as defined in the present arrangement by an inner surface of a respective one of the piston outers 1037. For such purposes the rings are preferably provided with suitable sealing elements 1060, which may comprise O-rings provided in suitable grooves provided in the rings, or otherwise.

The rings may be fixed in place using any suitable means, for example they may each be fixed in place using a circlip, by use of radially inwardly extending fasteners, or otherwise. In the present arrangement, however, the rings are fixed in place by load collars 1050, which are received by corresponding grooves 1051 in the activation shaft 1007, and are fastened to the faces of the rings, using bolts 1052 or other fasteners. In the present arrangement, the load collars are formed in two parts, which is preferable for ease of attachment. The present arrangement is not to be limited as such, however.

The second protrusions extending inwardly from the outer body of the tool 1000, which in the present arrangement are defined by the inward facing flanges 1039 of the piston outers 1037, sealingly engage the outer surface of the activation shaft 1007. For such purposes, the second protrusions are preferably provided with suitable sealing elements 1070, which may comprise O-rings provided in suitable grooves provided second protrusions, as shown, or otherwise. In an alternative arrangement, the activation shaft 1007 may instead be provided with the sealing elements. This alternative arrangement, is likely preferable. In such case, the outer surface of the activation shaft 1007 will be provided with suitable grooves for receiving the sealing elements, which again, may comprise O-rings.

Figure 25:
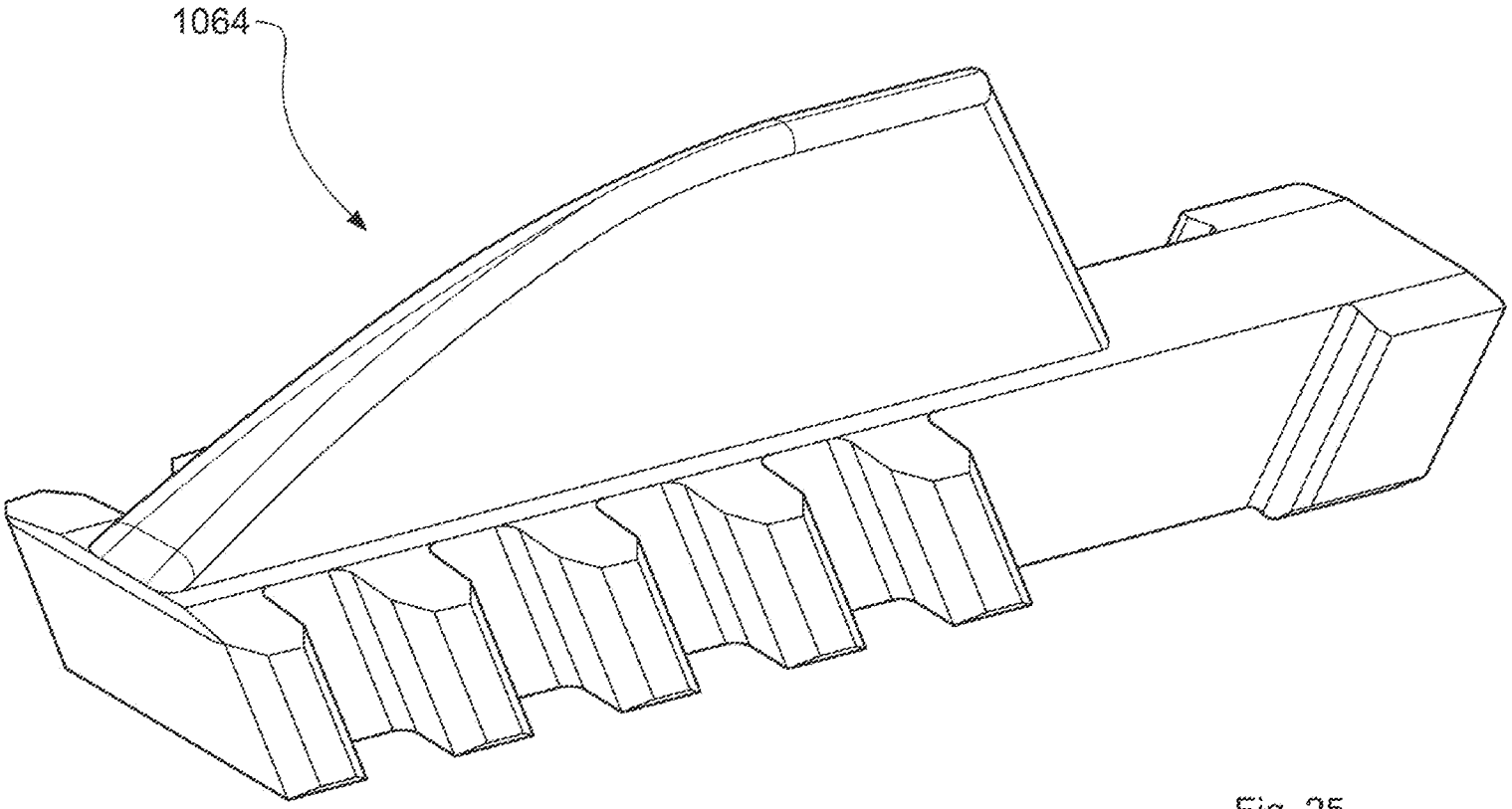
FIG. 25 shows a possible blade arrangement for use in the tool of FIG. 20.

Referring to FIG. 25, there is shown a detailed view of the blade 1064 of the arrangement of FIGS. 20 to 24. The main load bearing face is the broad face incorporated into the ramp/drive teeth profiles, in combination with the drive teeth. This end face is preferably combined with the drive teeth at this location to provide more surface area for load bearing on the end face than if the drive teeth are organised offset one pitch, or otherwise, i.e. the teeth are set back or removed from the blade end. The T-shape at the other end of the blade floats radially in the mating slot in the drive block which is moved axially by the outer housings and which allows the blade to float up/down the drive teeth ramps according to the direction of axial movement. The outer profile is substantially the opposite of that previously shown in respect of the other described arrangements.

It should be noted that the arrangement of FIGS. 20 to 24 is not to be limited to the use of blade as shown in FIG. 25 and may, for example, incorporate a blade of alternative form, such as a bade of a form previously discussed with respect to any of the other described arrangements. Correspondingly, any of the other arrangements, including those discussed with reference to FIGS. 1 to 19 may be adapted to incorporate a blade in accordance with that shown in FIG. 25.

In the examples discussed above, the tool has six or eight pistons. However, the invention is not limited as such, and any suitable number of pistons may be used. In some arrangements, for example there may be twelve or more pistons.

In one example above, five of the six pistons generate an activation force, i.e. a force that would tend to move the tool from the first configuration, in which the blades are retracted, into the second configuration, in which the blades are deployed, and one of the pistons generates a deactivation force, which would tend to move the tool from the second configuration to the first configuration.

As discussed above, in other embodiments all of the pistons of the tool may generate an activation force, with no pistons generating a deactivation force. In such embodiments, there is likely to be no need for a ball seat to be formed in the tool.

In yet further embodiments, more than one piston may generate a deactivation force. For instance, where a casing is relatively thick, or otherwise expected to be difficult to perforate (and also difficult to remove the blades from after the perforation takes place), the tool may have twelve pistons, ten of which generate an activation force and two of which generate a deactivation force.

Use of an activation shaft in place of a number of piston inners will generally increase the total number of pistons possible by reducing the number of mechanical connections between components.

In the examples above, slanted ribs are provided on the internal walls of the pockets of the blade carrier, and corresponding grooves are formed on the outer sides of the blades. However, this may be reversed, so that the blades have outwardly-protruding ribs, which are received in corresponding grooves formed in the walls of the pockets.

In the example discussed above, the outer sleeve is moved upwardly with respect to the mandrel to activate the tool. However, in alternative embodiments the outer sleeve may move downwardly with respect to the mandrel to activate the tool. The skilled reader will readily understand how the design of the tool may be adapted in these cases.

Compared to conventional perforators, such as shown in EP2616625, embodiments of the invention have drive pistons having components which form part of the outer housing of the tool and which move, with respect to a central mandrel of the tool, to activate and deactivate the tool, and which form part of the outer surface of the tool. As this occurs the mandrel will remain fixed in place with respect to the other components of the drill string.

One advantage of this is that gravity will, if the tool is (as will usually be the case) in an orientation with the top end 2 above the bottom end 4, assist more fully in returning the tool from the second position to the first (deactivated) position, as the outer sleeve components will drop downwardly once the drive pistons are deactivated.

In the examples discussed above, some of the drive pistons are positioned above the blades, and some are positioned below the blades. This arrangement helps with the distribution of forces within the tool as a whole.

When the tool is activated, and the blades encounter resistance when perforating a casing, components of the pistons above the blades will be placed under tension, and this effect will be cumulative. The greater the number of pistons above the blades, therefore, the greater the strain that will be applied to the weakest parts of the pistons, and the connections between the pistons. This effect may place an effective limit on the number of drive pistons that can reliably be positioned above the blades in the tool.

Similarly, during activation components of the pistons below the blades will be placed under compression, and this effect will once again be cumulative. This may also place an effective limit on the number of drive pistons that can be positioned below the blades.

Dividing the pistons so that some are positioned above the blades and others are positioned below the blades increases the overall number of pistons that can be provided as part of the tool, and also (for a given number of pistons) reduces the maximum forces experienced by certain components of the pistons during use.

However, in other embodiments of the invention all of the pistons may be above the blades, or all of the pistons may be below the blades.

In the embodiments shown in the figures, the upper surfaces of the travelling blocks 48 are generally perpendicular to the longitudinal axis of the tool 1. In other embodiments, these upper surfaces may be set at an angle to the longitudinal axis of the tool 1. In particular these surfaces may be set at exactly or substantially a right angle to the angle of the ribs 66 that are formed on the inner surfaces of the pockets 19. This will increase the bearing area available as the blades 64 are expanded, and hence increase the force that can be transferred to the casing during this process.

In the examples shown, slanting ribs 66 are provided in the inward-facing walls of the pockets 19 formed in the blade carrier 17, which is a component of the mandrel. However, in other embodiments the ribs may instead be provided on the blade housing 44, which is a component of the outer sleeve. In these embodiments ribs formed on the outer sleeve may be received in cooperating grooves formed on the outer sides of the blade body 67 of each blade 64. The skilled reader will understand that, in these embodiments, the blades 64 will be driven downwardly and outwardly with respect to the mandrel when the tool 1 is activated.

In these embodiments, the thickness of the blade housing 44, at least in the region where the ribs are formed, may need to be increased.

Figure 22:
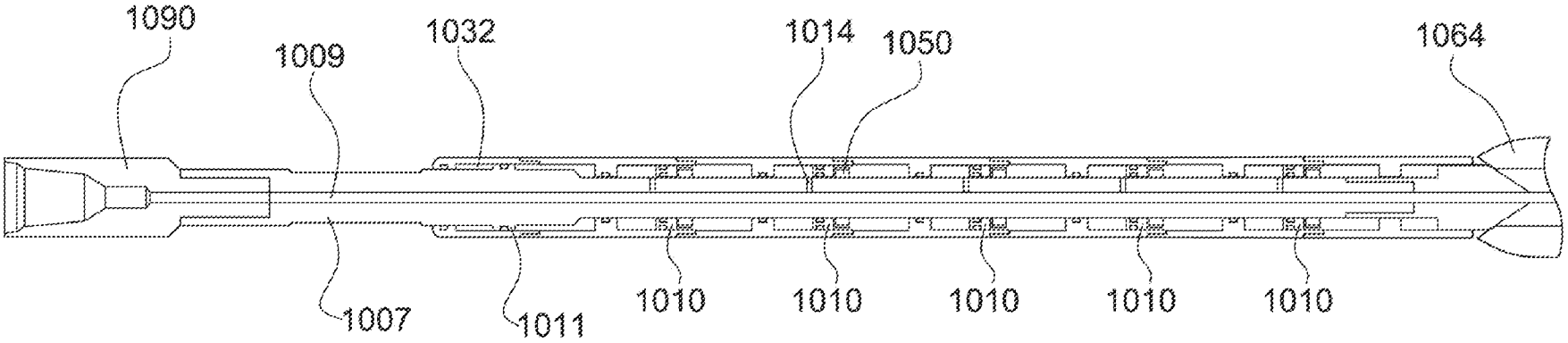
FIG. 22 shows a partial close up view of the tool of FIG. 20 showing the activation shaft.
Figure 23:
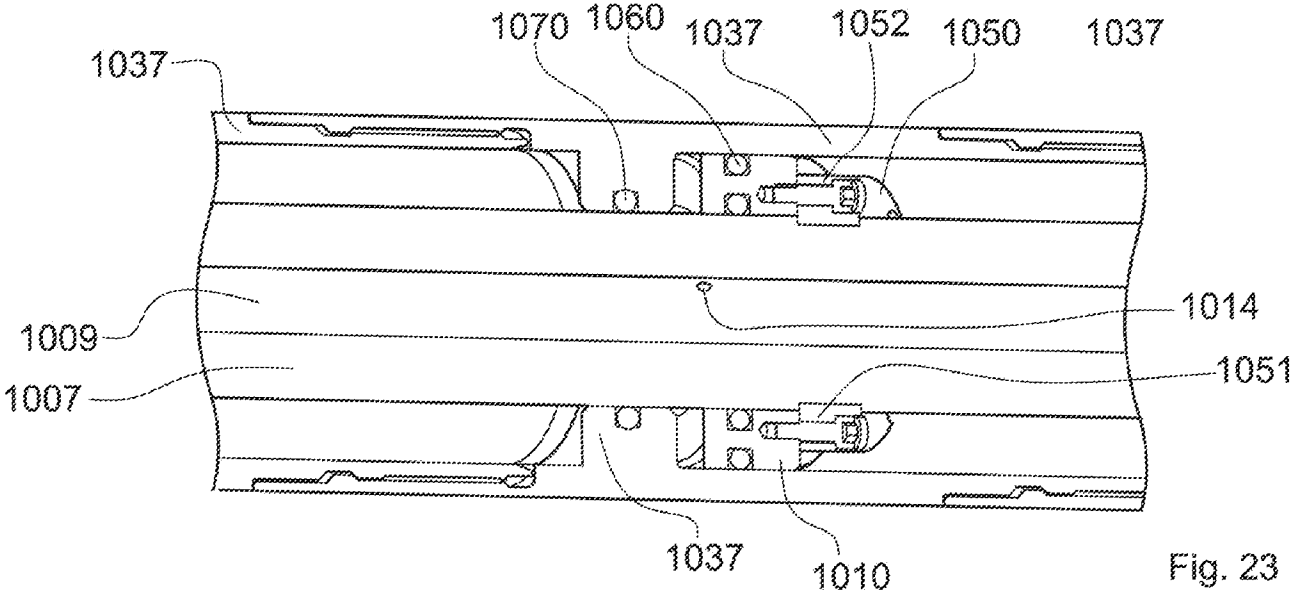
FIG. 23 shows a detailed view of the tool of FIG. 20.
Figure 24:
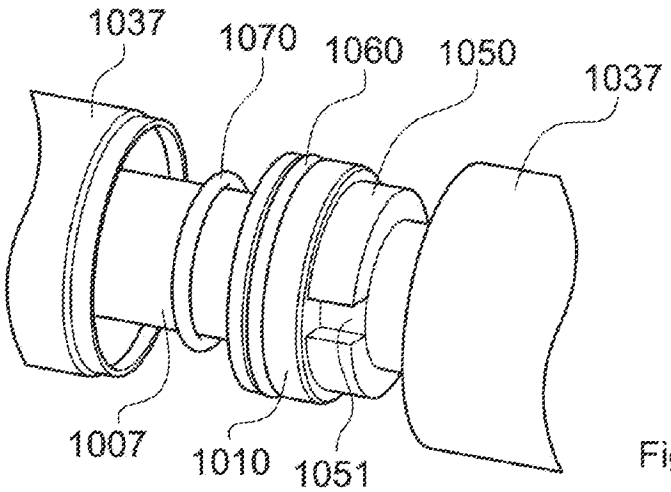
FIG. 24 shows a detailed view of the tool of FIG. 20 in a partly disassembled state.

The blades of any arrangements described may be arranged so that the leading edge of the blade comprises a rounded edge as seen, for example, in FIGS. 21 and 22. It may otherwise be sharp. The likely outcome of a rounded leading edge is that the perforation opening can be made using less mechanical force, which may be beneficial.

Tools embodying the invention may be used in downhole operations where more than one tool in a drill string is activated in the course of a single trip into the wellbore. For example, a drill string may be assembled including a tool according to the above, and a casing cutter. The tool is preferably positioned below the casing cutter, but this need not be the case. Operators can activate the tool to perforate the casing, either before or after the casing cutter has been used to cut the casing. In an example, the tool may be used first, to weaken the casing at a desired location, before the casing cutter is activated.

The construction of the tool, having a sturdy and robust set of inner components comprising the mandrel of the tool, means that the tool is well-suited to withstanding and transmitting rotational motion of the drill string as the casing cutter is used to cut the casing.

In examples where the tool is positioned below the casing cutter, a circulating sub may be positioned below the casing cutter and above the tool. When the casing cutter is to be activated, the circulating sub is operated to open one or more ports to the annulus. The circulating sub may also block flow to components below it, for instance through a ball being dropped to set the circulating sub. A high rate of flow through the casing cutter is likely to be needed while the casing cutter is being used, and the presence of the circulating sub means that this high flow can be diverted to the annulus without passing through the tool.

It is also envisaged that the tool may be used in examples where cement is pumped through the drill string, for instance to set a cement plug in the wellbore. In such examples, it will be preferable to block, initially, the communication ports that allow fluid to flow from the central flow bore of the tool to the various chambers thereof, so that cement does not enter these chambers as the cement passes through the flow bore. Once the cement has been displaced through the drill string, a suitable spacer (for instance comprising a sponge wiper and/or a quantity of fluid) may be pumped through the drill string, and the communication ports may then be opened so that the tool is ready for use. The initial closure, and subsequent opening, of the communication ports may be achieved, for example, through the use of burst discs or plugs, as the skilled reader will readily understand.

In other processes that may be carried out using a tool embodying the invention, the tool may be included in a drill string that includes a washing component, which is configured to direct jets of fluid radially outwardly. The tool may be activated to form perforations in the wellbore casing, as discussed above. The tool may then be deactivated, and the drill string raised or lowered within the wellbore so that the washing component is substantially level with the perforations that have been formed. The washing component is then activated to direct jets of fluid radially outwardly and through at least some of the perforations.

This may be done, for example, by dropping a ball or other object through the drill string to be received in a seat in or below the washing component, so that the flow of fluid below the washing component is at least substantially blocked. Fluid flowing down the drill string will then be directed outwardly through apertures in the washing component. The casing above the washing component may be isolated using a packoff, or other annular closing device.

Tools embodying the invention may also be used in plug and abandonment applications, where a bridge plug is initially set, and then the tool is activated to perforate the casing (or alternatively the casing may be perforated before the bridge plug is set). The perforation of the casing allows circulation to occur outside the casing. A cement plug can then be formed on top of the bridge plug, by pumping cement through the drill string.

In some processes carried out using tools embodying the invention, the drill string is held stationary or substantially stationary with respect to the wellbore as the blades are driven outwardly to perforate the casing. However, in other processes, the drill string (and hence the mandrel of the tool) may be moved axially with respect to the wellbore as the blades are expanded, to create longer cuts or scores in the casing. It is envisaged that the drill string may be moved repeatedly upwardly and downwardly, in a reciprocating motion, as the blades are expanded, so that the blades create elongated cuts or scores in the casing, and progressively cut deeper into the casing along these cuts or scores as the process goes on.

The tools discussed above contain blades or other cutters which are deployed when the tool is activated. However, the invention is not limited to this, and the skilled reader will appreciate that the drive system disclosed in this application may be used with other types of tool, in which components other than blades or cutters are deployed when the tool is activated. Methods are generally disclosed of providing a tool embodying the invention, including one or more components which are activated or operated by axial movement of the outer sleeve with respect to the mandrel, running the tool into a wellbore as part of a drill string, and then activating the tool to operate the component(s).

Tools embodying the present invention may provide significant advantages with respect to conventional tools of this type.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A downhole tool, comprising:

an inner body, having a first connection to connect the tool to an immediately upper component in a drill string and to receive fluid from the immediately upper component, and a second connection to connect the tool to an immediately lower component in a drill string and to deliver fluid to the immediately lower component, the inner body defining a flow bore therealong which communicates between the first connection and the second connection;

an outer body disposed around at least a part of the inner body;

a plurality of first protrusions extending outwardly from the inner body;

a plurality of second protrusions extending inwardly from the outer body;

a plurality of pressure chambers, each pressure chamber at least partly defined on an inner side by the inner body and on an outer side by the outer body, and at least partly defined on upper and lower sides by one of the first protrusions and one of the second protrusions; and a plurality of first flow ports, each of the first flow ports allowing fluid communication between the flow bore and one of the pressure chambers, wherein:

the outer body is axially movable with respect to the inner body, in a direction which is parallel or substantially parallel with a longitudinal axis of the tool, such that introduction of pressurised fluid into the pressure chambers tends to drive the outer body axially with respect to the inner body;

the first connection, the second connection and the plurality of first protrusions are fixed to one another and, in use of the tool, will not substantially move axially relative to one another; and the tool further comprises a component which is activated or operated by axial movement of the outer body with respect to the inner body.

2. A tool according to claim 1, wherein at least one of the pressure chambers is below the component, and at least one of the pressure chambers is above the component.

3. A tool according to claim 1, wherein the inner body comprises a plurality of piston inners, and the outer body comprises a plurality of corresponding piston outers, each piston outer at least partially surrounding the corresponding piston inner to form a piston which includes one of the pressure chambers.

4. A tool according to claim 3, wherein each piston inner includes an outwardly-protruding flange, which comprises one of the first protrusions.

5. A tool according to claim 3, wherein each piston outer includes an inwardly-protruding flange, which comprises one of the second protrusions.

6. A tool according to claim 1, wherein the inner body comprises a shaft, which extends continuously between the first connection and the component.

7. A tool according to claim 6, wherein the first protrusions comprise piston members that are attached to the shaft.

8. A tool according to claim 6, wherein the outer body comprises a plurality of piston outers, each piston outer at least partially surrounding a corresponding one of the first protrusions to form a piston which includes one of the pressure chambers.

9. A tool according to claim 8, wherein each piston outer includes an inwardly-protruding flange, which comprises one of the second protrusions.

10. A tool according to claim 1, wherein the component comprises one or more elements which are driven radially inwardly or outwardly with respect to the inner body by axial movement of the outer body with respect to the inner body.

11. A tool according to claim 10, wherein the elements comprise blades or cutters.

12. A tool according to claim 10, wherein:

the tool has a first configuration, in which the elements are retracted;

the tool has a second configuration, in which the elements are activated, and protrude radially outwardly to a greater extent from a longitudinal axis of the tool than in the first configuration.

13. A method of perforating a wellbore casing, comprising the steps of:

providing a drill string including a tool according to claim 10;

running the drill string into a wellbore having a casing, to a desired depth; and activating the tool to drive the elements outwardly into engagement with the casing.

14. A method according to claim 13, further comprising the steps of:

including the tool in a drill string;

further including a casing cutter in the drill string; and cutting the casing of the wellbore using the casing cutter during the same trip into the wellbore.

15. A tool according to claim 1, wherein the pressure chambers comprise at least one first pressure chamber, communicating with the flow bore, wherein the introduction of pressurised fluid into the first pressure chamber tends to drive the outer body axially with respect to the inner body in a first direction, and at least one second pressure chamber, communicating with the flow bore, wherein the introduction of pressurised fluid into the second pressure chamber tends to drive the outer body axially with respect to the inner body in a second direction, which is opposite or substantially opposite to the first.

16. A tool according to claim 15, further comprising an isolation arrangement, wherein when the isolation arrangement is activated fluid flow from the first connection to the or each first pressure chamber is blocked or substantially blocked, and fluid may flow from the first connection to the or each second pressure chamber.

17. A tool according to claim 1, further comprising a vent allowing fluid flow from the flow bore to an exterior of the tool, and wherein the vent is open at or near the limit of the motion of the outer body with respect to the inner body in a first direction, and closed during other relative positions between the inner and outer body.

18. A tool according to claim 1, comprising a latch arrangement which may be moved between an engaged state and a disengaged state, and where when the latch arrangement is in the engaged state, the latch arrangement substantially prevents relative axial movement of the inner body and the outer body.

19. A tool according to claim 18, wherein the latch arrangement comprises:

a latch element having a resilient part, the latch element being carried by or fixed in relation to one of the inner body and the outer body;

a receiver having a recess in which a part of the latch element is received, the receiver being carried by, or fixed in relation to, the other one of the inner body and the outer body.

20. A tool according to claim 19, wherein the latch arrangement further comprises a blocking component which, in a first position, prevents the resilient part of the latch element from deforming to allow the part of the latch to be removed from the recess, and in a second position does not prevent the resilient part of the latch element from deforming to allow the part of the latch to be removed from the recess.

* * * * *